US006314262B1

(12) United States Patent
Kunihiro et al.

(10) Patent No.: US 6,314,262 B1
(45) Date of Patent: Nov. 6, 2001

(54) TONER SUPPLY SYSTEM AND TONER CARTRIDGE

(75) Inventors: Hisashi Kunihiro, Yamabe-gun; Akira Nakakuma, Kitakatsuragi-gun; Fumito Mizoguchi, Yamatokoriyama; Kenichi Nagata, Shiki-gun; Yoshiki Ichikawa, Kashihara, all of (JP)

(73) Assignee: Sharp Kabushiki Kaisha (JP)

( * ) Notice: Subject to any disclaimer, the term of this patent is extended or adjusted under 35 U.S.C. 154(b) by 0 days.

(21) Appl. No.: 09/604,533

(22) Filed: Jun. 27, 2000

(30) Foreign Application Priority Data

Jul. 23, 1999 (JP) ..... 11-208726
Aug. 10, 1999 (JP) ..... 11-225875
Aug. 10, 1999 (JP) ..... 11-225876

(51) Int. Cl.[7] ..... G03G 15/08

(52) U.S. Cl. ..... 399/258; 399/120; 399/262; 222/DIG. 1

(58) Field of Search ..... 222/DIG. 1; 399/120, 399/258, 260, 261, 262, 263

(56) References Cited

U.S. PATENT DOCUMENTS 5,089,854 * 2/1992 Kaieda et al. ..... 399/258
5,475,479 * 12/1995 Katakeyama ..... 399/258
5,737,675 * 4/1998 Okada et al. ..... 399/258
5,933,691 * 8/1999 Johroku ..... 399/262

FOREIGN PATENT DOCUMENTS 5289516 11/1993 (JP) .

* cited by examiner

*Primary Examiner*—Arthur T. Grimley
*Assistant Examiner*—Hoang Ngo

(57) ABSTRACT

A shutoff lid of a toner hopper is formed with locking elements for locking the lid and a fixing element for fixing the locking elements. In the front face of a bottle slider, a pair of projected abutments abutting the fixing element are arranged on the left and right sides and a pair of switching portions for moving the locking elements are formed. The rear face of the fixing element is shaped with a stepped face which corresponds to the projected abutments. As the bottle slider moves forwards, each projected abutment abuts the stepped face of the fixing element and moves the fixing element, to thereby cancel restraint of the fixing element on the locking elements. A further advancement of the bottle slider causes the locking elements to move and release the locked state. If a projected abutment does not match the fixing element, the fixing element cannot be moved thus making release of the lock impossible. On the other hand, when the bottle slider has reached the toner supply position, contact portions of the releasing elements oppose a guide frame. When the releasing element is rotated about bridges by holding its handle, the contact portions abut the guide frame and function as the fulcrum so as to act a leverage force on the bridges, whereby it is possible to break off the bridges by a weak force. Thus, the releasing element is separated from the bottle slider and then a sealing element is peeled off.

37 Claims, 31 Drawing Sheets

TONER SUPPLY SYSTEM AND TONER CARTRIDGE

BACKGROUND OF THE INVENTION (1) Field of the Invention

The present invention relates to a toner cartridge for storing a toner used in an image forming apparatus such as copier, printer and the like as well as relating to a toner supply system for supplying the toner stored in the toner cartridge to the toner hopper in the image forming apparatus.

(2) Description of the Prior Art

A typical toner supply system in conventional copiers is for supplying the toner from the toner bottle of the toner cartridge to the toner hopper incorporated in the top part of the copier body. This toner hopper is enclosed by a cover attached to the copier body and has a toner entrance port on the top surface thereof with a slidable shutoff lid covering the port. The toner cartridge has a toner supply opening with a slider attached on the toner supply opening. The toner cartridge also has a detachable cartridge cover fitted on the slider so as to close the opening.

In supplying the toner from the toner carriage to the toner hopper, first the cover enclosing the top surface of the toner hopper is opened. Then, while the positioning hole formed on the toner cartridge side is fitted on the positioning pin formed on the top surface of the toner hopper, the slot of the slider is fitted to the projection of the shutoff lid. The toner cartridge is then slid whilst both sides of the slider are being guided along the guide frame arranged on the top of the hopper, so that the opening of the toner cartridge is moved to above the toner entrance port. With this movement, the shutoff lid is set open. In this state, the seal as a sealing element applied enclosing the toner supply opening on the slider's undersurface is pulled off and the top part of the toner cartridge is tapped a number of times so that the toner falls into the toner hopper.

To remove the emptied toner cartridge when the toner supply has been finished, the reverse movement to the above is made and the cover is closed at the end.

The conventional toner supply system permits the operator to readily slide the shutoff lid covering the toner entrance port, manually or with insertion of a tool etc. Therefore, if the shutoff lid is slid without enough caution, dust and dirt and other foreign matter may enter the toner hopper through the toner entrance port. Or there has been a concern that unrecommended toner for other types or toner different in color may be charged erroneously.

Further, in the state where the slider of the toner cartridge has not been guided at all by the guide frame when the toner should be supplied, or when the toner cartridge is left to stand on its own, the seal closing the toner supply opening of the toner cartridge can be peeled off . Therefore, there are risks that the toner content may be used for other types of machines and that the toner may be degraded in quality and characteristics due to exposure to its surrounding for a long period of time after the seal has once been opened, thus possibly causing unexpected deterioration of the image quality and other troubles.

For example, Japanese Patent Application Laid-Open Hei 5 No. 289516 (Patent No. 2802854) discloses a toner supply system which permits toner supply only when the toner cartridge has been guided properly into the guide frame. This toner supply system is configured so that the shutoff lid in the toner entrance port is locked by a locking mechanism, whereby the shutoff lid will not be open unintentionally.

This locking mechanism includes an engaging element which is adapted to abut the disengaging piece formed on the bottle slider on the toner cartridge side only when the bottle slider has been correctly guided by the guide frame. The lock is disengaged by rotating the engaging element, to thereby allow the shutoff lid to be opened.

Accordingly, in the above configuration, if a toner cartridge without the disengaging piece is tried to mounted, the locking mechanism will not be disengaged, whereby it is possible to prohibit use of toner cartridges which do not have the disengaging piece. However, since the suitability of the toner cartridge to be used is determined only by the presence of the disengaging piece, it is difficult to provide an active configuration which permits use of one type of toner cartridge having an appropriate toner while prohibiting other types of toner cartridges, in a product lineup of multiple types of machines using diverse kinds of toner, or which permits the use of one toner cartridge having a toner of a correct color while prohibiting toner cartridges of the other colors in a color copier. Or simply, the varieties of the mating combinations between the disengaging piece formed on the toner cartridge side and the engaging element provided on the shutoff lid side are limited. Therefore, if there are many toner types, it is very difficult to identify the toner type at first glance, and also it is difficult to design the pattern of the disengaging piece and engaging element. For such reasons, even if a disengaging piece and engaging element do not match perfectly, use of a toner cartridge might be nevertheless permitted if they have some similarity.

SUMMARY OF THE INVENTION

In view of the above problems, it is therefore an object of the present invention to provide a toner supply system and a toner cartridge whereby accidental opening of the shutoff lid can be prevented so as to keep out dust, dirt and foreign matter and erroneous charging of toners for other machines or toners of difference colors can be prohibited. It is another object of the present invention to provide a toner supply system and a toner cartridge which can prevent use of the toner to other machines as well as prevent use of the toner which has lowered in its quality and characteristics. It is a further object of the present invention to provide a toner cartridge which allows for smooth removal of the sealing element after the shutoff lid has been open.

In order to achieve the above object, the present invention is configured as follows:

In accordance with the first aspect of the present invention, a toner supply system for supplying a toner hopper with the toner from a toner cartridge via a toner entrance port formed on the toner hopper is characterized in that the toner hopper includes:

a shutoff lid disposed movably along the top surface thereof for opening and closing the toner entrance port;

a guide frame disposed along the walls defining the toner entrance port for guiding the shutoff lid in the opening and closing directions thereof;

a locking element for keeping the shutoff lid in the closed state; and a fixing element fixing the locking element and having a stepped face on one side thereof, the toner cartridge includes:

a releasing element which has a stepped face mating the stepped face of the fixing element and moves the fixing element so as to allow the locking element to move as the toner cartridge moves forwards; and an opening and closing element which moves the locking element so as to move the shutoff lid, and in that when the toner cartridge is mounted on the mount of the toner hopper, the releasing element and the fixing element are placed opposing each other with their stepped faces opposed to each other and the two stepped faces mesh with each other as the toner cartridge moves forwards, whereby the fixing element is allowed to move and the shutoff lid can be opened.

In accordance with the second aspect of the present invention, a toner supply system for supplying a toner hopper with the toner from a toner cartridge via a toner entrance port formed on the toner hopper is characterized in that the toner hopper includes:

a shutoff lid disposed movably along the top surface thereof for opening and closing the toner entrance port;

a guide frame disposed along the walls defining the toner entrance port for guiding the shutoff lid in the opening and closing directions thereof;

a locking element for keeping the shutoff lid in the closed state; and a fixing element fixing the locking element and having a stepped face on one side thereof, the toner cartridge includes:

a releasing element which has a stepped face mating the stepped face of the fixing element and moves the fixing element so as to allow the locking element to move as the toner cartridge moves forwards; and an opening and closing element which moves the locking element so as to move the shutoff lid, and when the toner cartridge is mounted on the mount of the toner hopper, the releasing element and the fixing element are placed opposing each other with their stepped faces opposed to each other and the two stepped faces mesh with each other as the toner cartridge moves forwards, whereby the fixing element is allowed to move and the shutoff lid can be opened, and in that the shutoff lid has a guide portion that loosely holds the fixing element and guides the fixing element in the opening and closing directions while the guide portion constrains the moving range of the fixing element when the toner cartridge moves forwards.

In accordance with the third aspect of the present invention, the toner supply system having the above second feature is characterized in that the fixing element has a spindle formed thereon while the guide portion is formed of a guide slot extending in parallel to the opening and closing direction and loosely holds the spindle so that the fixing element can sway about the spindle, and only when the fixing element makes parallel movement without swaying, the fixing element permits the locking element to switch from the engaging position where the locking element engages the guide frame to the releasing position where the locking element is disengaged from the guide frame.

In accordance with the fourth aspect of the present invention, a toner supply system for supplying a toner hopper with the toner from a toner cartridge via a toner entrance port formed on the toner hopper is characterized in that the toner hopper includes:

a shutoff lid disposed movably along the top surface thereof for opening and closing the toner entrance port;

a guide frame disposed along the walls defining the toner entrance port for guiding the shutoff lid in the opening and closing directions thereof;

a locking element for keeping the shutoff lid in the closed state; and a fixing element fixing the locking element and having a stepped face on one side thereof, the toner cartridge includes:

a releasing element which has a stepped face mating the stepped face of the fixing element and moves the fixing element so as to allow the locking element to move as the toner cartridge moves forwards; and an opening and closing element which causes the locking element to move so as to release the engagement between the locking element and the guide frame and move the shutoff lid, and in that when the toner cartridge is mounted on the mount of the toner hopper, the releasing element and the fixing element are placed opposing each other with their stepped faces opposed to each other and the two stepped faces mesh with each other as the toner cartridge moves forwards whereby the fixing element is allowed to move and the shutoff lid can be opened, and in that the opening and closing element has an engaging portion which engages the locking element having been disengaged from the guide frame and being in the releasing position and the engaging portion engages the locking element so as to move the shutoff lid as the toner cartridge moves rearwards.

In accordance with the fifth aspect of the present invention, the toner supply system having the above fourth feature is characterized in that the locking element has a hooking portion that engages the engaging portion of the opening and closing element when the locking element is in the releasing position and the outer end face of the engaging portion is formed closer to the guide frame than the inner end face of the hooking portion so that the engaging portion urges the locking element towards the guide frame as the toner cartridge moves rearwards.

In accordance with the sixth aspect of the present invention, a toner supply system for supplying a toner hopper with the toner from a toner cartridge via a toner entrance port formed on the toner hopper is characterized in that the toner hopper includes:

a shutoff lid disposed movably along the top surface thereof for opening and closing the toner entrance port;

a guide frame disposed along the walls defining the toner entrance port for guiding the shutoff lid in the opening and closing directions thereof;

a locking element for keeping the shutoff lid in the closed state; and a fixing element fixing the locking element and having a stepped face on one side thereof, the toner cartridge includes:

a releasing element which has a stepped face mating the stepped face of the fixing element and moves the fixing element so as to allow the locking element to move as the toner cartridge moves forwards; and an opening and closing element which moves the locking element so as to move the shutoff lid, and in that when the toner cartridge is mounted on the mount of the toner hopper, the releasing element and the fixing element are placed opposing each other with their stepped faces opposed to each other and the two stepped faces mesh with each other as the toner cartridge moves forwards, whereby the fixing element is allowed to move and the shutoff lid can be opened, and in that the toner cartridge further comprises a sealing element covering the toner supply opening thereof, the sealing element is attached to an attachment structure which is constructed by either the opening and closing element or releasing element, and the attachment structure is integrally formed with the toner cartridge in a separable manner so that the sealing element is peeled from the toner cartridge by separating the attachment structure from the toner cartridge.

In accordance with the seventh aspect of the present invention, the toner supply system having the above sixth feature is characterized in that the attachment structure is supported rotatably by the toner cartridge, the shutoff lid has an anti-rotational element that is put in contact with the attachment structure so as to limit the rotation of the attachment structure, the anti-rotational element has a hollow allowing rotation of the attachment structure, and when the toner cartridge has moved to a position where the shutoff lid is opened and the opening of the toner cartridge is aligned with the toner entrance port so as to create communication therebetween, a handle reaches the hollow and becomes allowed to rotate and be removed from the toner cartridge.

In accordance with the eighth aspect of the present invention, the toner supply system having the above first feature is characterized in that the opening and closing element is formed with a switching portion which abuts the locking element and causes the locking element to switch from the engaging position where the locking element engages the guide frame to the releasing position where the locking element is disengaged from the guide frame, and the distance between the stepped face of the fixing element and the stepped face of the releasing element is shorter than the distance between the locking element and the switching portion when the toner cartridge is placed on the mount.

In accordance with the ninth aspect of the present invention, the toner supply system having the above second feature is characterized in that the opening and closing element is formed with a switching portion which abuts the locking element and causes the locking element to switch from the engaging position where the locking element engages the guide frame to the releasing position where the locking element is disengaged from the guide frame, and the distance between the stepped face of the fixing element and the stepped face of the releasing element is shorter than the distance between the locking element and the switching portion when the toner cartridge is placed on the mount.

In accordance with the tenth aspect of the present invention, the toner supply system having the above fourth feature is characterized in that the opening and closing element is formed with a switching portion which abuts the locking element and causes the locking element to switch from the engaging position where the locking element engages the guide frame to the releasing position where the locking element is disengaged from the guide frame, and the distance between the stepped face of the fixing element and the stepped face of the releasing element is shorter than the distance between the locking element and the switching portion when the toner cartridge is placed on the mount.

In accordance with the eleventh aspect of the present invention, the toner supply system having the above sixth feature is characterized in that the opening and closing element is formed with a switching portion which abuts the locking element and causes the locking element to switch from the engaging position where the locking element engages the guide frame to the releasing position where the locking element is disengaged from the guide frame, and the distance between the stepped face of the fixing element and the stepped face of the releasing element is shorter than the distance between the locking element and the switching portion when the toner cartridge is placed on the mount.

In accordance with the twelfth aspect of the present invention, the toner supply system having the above eighth feature is characterized in that the fixing element is formed with a bearing portion that abuts the locking element and keeps the locking element in the engaging position while the locking element is formed with a constraint avoidance portion which allows avoidance of the constraint by the bearing portion when the locking element is set into the releasing position, and the distance between the bearing portion and the constraint avoidance portion is specified to be shorter than the distance between the switching portion and the locking element in the state where the stepped face of the fixing element meshes the stepped face of the releasing element.

In accordance with the thirteenth aspect of the present invention, the toner supply system having the above ninth feature is characterized in that the fixing element is formed with a bearing portion that abuts the locking element and keeps the locking element in the engaging position while the locking element is formed with a constraint avoidance portion which allows avoidance of the constraint by the bearing portion when the locking element is set into the releasing position, and the distance between the bearing portion and the constraint avoidance portion is specified to be shorter than the distance between the switching portion and the locking element when the stepped face of the fixing element meshes the stepped face of the releasing element.

In accordance with the fourteenth aspect of the present invention, the toner supply system having the above tenth feature is characterized in that the fixing element is formed with a bearing portion that abuts the locking element and keeps the locking element in the engaging position while the locking element is formed with a constraint avoidance portion which allows avoidance of the constraint by the bearing portion when the locking element is set into the releasing position, and the distance between the bearing portion and the constraint avoidance portion is specified to be shorter than the distance between the switching portion and the locking element when the stepped face of the fixing element meshes the stepped face of the releasing element.

In accordance with the fifteenth aspect of the present invention, the toner supply system having the above eleventh feature is characterized in that the fixing element is formed with a bearing portion that abuts the locking element and keeps the locking element in the engaging position while the locking element is formed with a constraint avoidance portion which allows avoidance of the constraint by the bearing portion when the locking element is set into the releasing position, and the distance between the bearing portion and the constraint avoidance portion is specified to be shorter than the distance between the switching portion and the locking element when the stepped face of the fixing element meshes the stepped face of the releasing element.

In accordance with the sixteenth aspect of the present invention, the toner supply system having the above twelfth feature is characterized in that the fixing element has an elastic portion for elastically and movably supporting the bearing portion, and the movement of the bearing portion switches the position of the locking element into the releasing position.

In accordance with the seventeenth aspect of the present invention, the toner supply system having the above thirteenth feature is characterized in that the fixing element has an elastic portion for elastically and movably supporting the bearing portion, and the movement of the bearing portion switches the position of the locking element into the releasing position.

In accordance with the eighteenth aspect of the present invention, the toner supply system having the above fourteenth feature is characterized in that the fixing element has an elastic portion for elastically and movably supporting the bearing portion, and the movement of the bearing portion switches the position of the locking element into the releasing position.

In accordance with the nineteenth aspect of the present invention, the toner supply system having the above fifteenth feature is characterized in that the fixing element has an elastic portion for elastically and movably supporting the bearing portion, and the movement of the bearing portion switches the position of the locking element into the releasing position.

In accordance with the twentieth aspect of the present invention, a toner supply system for supplying a toner hopper with the toner from a toner cartridge via a toner entrance port formed on the toner hopper is characterized in that the toner hopper includes:

a shutoff lid disposed movably along the top surface thereof for opening and closing the toner entrance port;

a guide frame disposed along the walls defining the toner entrance port for guiding the shutoff lid in the opening and closing directions thereof;

a locking element for keeping the shutoff lid in the closed state; and a fixing element fixing the locking element and having a stepped face on one side thereof, the toner cartridge includes:

a releasing element which has a stepped face mating the stepped face of the fixing element and moves the fixing element so as to allow the locking element to move as the toner cartridge moves forward; and an opening and closing element which moves the locking element so as to move the shutoff lid, and in that one end of a sealing element for covering the toner supply opening of the toner cartridge body is attached to the releasing element and the releasing element is configured so as to be separable from the toner cartridge body, and in that the faces of the fixing element and releasing element which oppose when the toner cartridge is set on the toner hopper are formed with stepped faces mating with each other and a stiffening rib is formed in the toner cartridge body while the shutoff lid has a guide which permits the stiffening rib to fit therein.

In accordance with the twenty-first aspect of the present invention, a toner cartridge for supplying a toner to a toner hopper which has a shutoff lid for opening and closing a toner entrance port thereof, a locking element for keeping the shutoff lid in the closed state and a fixing element for fixing the locking element, via the toner entrance port by opening the shutoff lid, includes:

a releasing element which moves the fixing element so as to allow the locking element to move; and an opening and closing element which moves the shutoff lid whilst moving the locking element, and is characterized in that the releasing element is formed with a stepped face so as to mate with the stepped face formed on the fixing element, and when the two stepped faces mesh with each other, the fixing element is moved so as to allow the shutoff lid to open.

In accordance with the twenty-second aspect of the present invention, the toner cartridge having the above twenty-first feature, further includes: a sealing element covering the toner supply opening, wherein the sealing element is integrally joined to the opening and closing element or the releasing element so that the sealing element is peeled off by separating the opening and closing element or the releasing element from the toner cartridge.

In accordance with the twenty-third aspect of the present invention, a toner cartridge for supplying a toner to a toner hopper which has a shutoff lid for opening and closing a toner entrance port thereof, a guide frame disposed along the walls defining the toner entrance port for guiding the shutoff lid in the opening and closing direction thereof, a locking element for keeping the shutoff lid in the closed state and a fixing element fixing the locking element, via the toner entrance port by opening the shutoff lid in the toner supply position, includes:

a releasing element which moves the fixing element so as to release the locked state by the locking element, the releasing element being separably attached to the toner cartridge body; and a sealing element covering the toner supply opening of the toner cartridge body, wherein one end of the sealing element is attached to the releasing element.

In accordance with the twenty-fourth aspect of the present invention, the toner cartridge having the above twenty-third feature is characterized in that a slack is formed on one side of the sealing element.

In accordance with the twenty-fifth aspect of the present invention, the toner cartridge having the above twenty-fourth feature is characterized in that the slack of the sealing element is temporarily tacked to the toner cartridge body or the releasing element.

In accordance with the twenty-sixth aspect of the present invention, a toner cartridge for supplying a toner to a toner hopper which has a shutoff lid for opening and closing a toner entrance port thereof, a guide frame disposed along the walls defining the toner entrance port for guiding the shutoff lid in the opening and closing direction thereof, a locking element for keeping the shutoff lid in the closed state and a fixing element fixing the locking element, via the toner entrance port by opening the shutoff lid in the toner supply position, includes:

a releasing element which moves the fixing element so as to release the locked state by the locking element, the releasing element being formed with the toner cartridge body in such a manner as to be separable from the toner cartridge body by bridges, the releasing element being adapted to be rotatable about the same axis as that of the bridges; and a sealing element covering the toner supply opening of the toner cartridge body, with one end thereof attached to the releasing element, and is characterized in that the releasing element is formed with a projection which avoids contact between the front end of the releasing element and the shutoff lid and comes into uniform contact with the shutoff lid when the releasing element is rotated for separation.

In accordance with the twenty-seventh aspect of the present invention, a toner cartridge for supplying a toner to a toner hopper which has a shutoff lid for opening and closing a toner entrance port thereof, a guide frame disposed along the walls defining the toner entrance port for guiding the shutoff lid in the opening and closing direction thereof, a locking element for keeping the shutoff lid in the closed state and a fixing element fixing the locking element, via the toner entrance port by opening the shutoff lid in the toner supply position, includes:

a releasing element which moves the fixing element so as to release the locked state by the locking element, the releasing element being formed with the toner cartridge body in such a manner as to be separable from the toner cartridge body by bridges, the releasing element being adapted to be rotatable about the same axis as that of the bridges; and a sealing element covering the toner supply opening of the toner cartridge body, with one end thereof attached to the releasing element, and is characterized in that a restraining rib for positioning the releasing element in the toner supply position is provided.

In accordance with the twenty-eighth aspect of the present invention, the toner cartridge having the above twenty-seventh feature is characterized in that the restraining rib is formed in the toner cartridge body on the same axis as that of the bridges and comes into contact with the guide frame when the releasing element has been rotated in the toner supply position.

In accordance with the twenty-nine aspect of the present invention, a toner cartridge for supplying a toner to a toner hopper which has a shutoff lid for opening and closing a toner entrance port thereof, a guide frame disposed along the walls defining the toner entrance port for guiding the shutoff lid in the opening and closing direction thereof, a locking element for keeping the shutoff lid in the closed state and a fixing element fixing the locking element, via the toner entrance port by opening the shutoff lid in the toner supply position, includes:

a releasing element which moves the fixing element so as to release the locked state by the locking element, the releasing element being formed with the toner cartridge body in such a manner as to be separable from the toner cartridge body by bridges, the releasing element being adapted to be rotatable about the same axis as that of the bridges; and a sealing element covering the toner supply opening of the toner cartridge body, with one end thereof attached to the releasing element, and is characterized in that a contact portion opposing the guide frame in the toner supply position is formed in the releasing element and the contact portion abuts the guide frame and functions as the fulcrum so as to act a leverage force on the bridges when the releasing element is rotated.

In accordance with the thirtieth aspect of the present invention, the toner cartridge having the above twenty-ninth feature is characterized in that the releasing element is formed of a material softer than that of the guide frame.

In accordance with the thirty-first aspect of the present invention, a toner cartridge for supplying a toner to a toner hopper which has a shutoff lid for opening and closing a toner entrance port thereof, a guide frame disposed along the walls defining the toner entrance port for guiding the shutoff lid in the opening and closing direction thereof, a locking element for keeping the shutoff lid in the closed state and a fixing element fixing the locking element, via the toner entrance port by opening the shutoff lid in the toner supply position, includes:

a releasing element which moves the fixing element so as to release the locked state by the locking element; and a sealing element covering the toner supply opening of the toner cartridge body, with one end thereof attached to the releasing element, and is characterized in that the releasing element is connected to the toner cartridge body by multiple bridges and sub-bridges and is adapted to be rotatable about the same axis as that of the bridges, and the sub-bridges other than the above bridges which serve the rotational center have a smaller sectional area than that of the bridges.

In accordance with the thirty-second aspect of the present invention, a toner cartridge for use in a toner supply system which has a toner hopper including a shutoff lid for opening and closing a toner entrance port thereof, a guide frame disposed along the walls defining the toner entrance port for guiding the shutoff lid in the opening and closing direction thereof, a locking element for keeping the shutoff lid in the closed state and a fixing element fixing the locking element and opens the shutoff lid as the toner cartridge body is moved forwards so as to allow the toner to be supplied through the toner entrance port, is characterized in that the cartridge body is provided on the front side thereof with a projected abutment which abuts the fixing element and moves it so as to allow the locking element to move and a switching portion which moves the locking element so as to move the shutoff lid.

In accordance with the thirty-third aspect of the present invention, the toner cartridge having the above thirty-second feature is characterized in that the projected abutment is located at a retracted position with respect to the front end of the toner cartridge body.

In accordance with the thirty-fourth aspect of the present invention, the toner cartridge having the above thirty-second feature is characterized in that the projected abutment and the switching portion are integrally formed and the projected portion is arranged to the front side with respect to the switching portion.

In accordance with the thirty-fifth aspect of the present invention, the toner cartridge having the above thirty-third feature is characterized in that more than one projected abutment are formed on the left and right sides on the front side of the toner cartridge body.

In accordance with the thirty-sixth aspect of the present invention, the toner cartridge having the above thirty-fourth feature is characterized in that more than one projected abutment are formed on the left and right sides on the front side of the toner cartridge body.

In accordance with the thirty-seventh aspect of the present invention, the toner cartridge having the above thirty-fourth feature is characterized in that an engaging portion that engages the locking element when the locked state is released and the engaging portion and the projected abutment are formed as one element and the projected abutment is located to the front side with respect to the engaging portion.

As has been described above, in the case where the shutoff lid for closing the toner entrance port of the toner hopper is opened and closed using a toner cartridge, the present invention allows the shutoff lid to be opened when a toner cartridge which is suited to the toner hopper is set. As a locking mechanism, the toner hopper includes a locking element for retaining the shutoff lid in the closed state and a fixing element for fixing the locking element. As the opening and closing mechanism for releasing the locked state of the locking mechanism, the toner cartridge includes a releasing element which moves the fixing element so as to allow the locking element to move as the toner cartridge moves forwards and an opening and closing element which moves the locking element so as to move the shutoff lid. The faces of the fixing element and releasing element opposing each other when the toner cartridge is mounted on the toner hopper are formed with stepped portions so that the two stepped faces mesh with each other.

When the toner cartridge moves forwards and the two stepped faces mesh with each other, the fixing element is moved first by releasing element, so as to cancel the restraint of the fixing element on the locking element. Then, the locking element is moved by the opening and closing element so as to disengage the locked state by the locking element, thus the shutoff lid can be opened. Here, the two stepped faces need not snuggly fit to each other and should be dimensioned so they work in the order mentioned above.

For attaining the operation as above, the geometrical arrangement of the releasing element and fixing element are related with that of the opening and closing element and the locking element. More specifically, when the toner cartridge is mounted on the toner hopper, the distance between the stepped face of the fixing element and the stepped face of the releasing element is specified to be smaller than the distance between the locking element and the opening and closing element. Further, the fixing element is formed with a bearing portion that abuts the locking element and keeps the locking element in its engaging position where it engages the guide frame while the locking element is formed with a constraint avoidance portion which allows avoidance of the constraint by the bearing portion when the locking element is set into the releasing position. In the state where the stepped face of the fixing element meshes the stepped face of the releasing element, the distance from the bearing portion to the constraint avoidance portion should be specified to be shorter than the distance between the opening and closing element and the locking element. With these specifications, the releasing element first abuts the fixing element so as to cancel the constraint by the bearing portion on the locking element, thus allowing the locking element to move. Then, the opening and closing element abuts the locking element so as to move the locking element, whereby the locked state to the shutoff lid is released thus enabling movement of the shutoff lid.

Accordingly, if a toner cartridge which is unsuited to the toner hopper is mounted, the two stepped faces will not mesh properly with each other. Therefore, the locked state by the locking element will not be canceled, thus prohibiting the shutoff lid from being opened. Thereby, it is impossible to open the shutoff lid by attaching a toner cartridge holding a toner for any other machine or a toner of different color, so that erroneous toner charging can be prevented.

When the movable fixing element is adapted to be guided in the opening and closing directions while the range of movement is limited, it is possible to prevent the fixing element from being pushed too far and hence prevent the restriction on the locking element from being canceled when the lid is tried to be opened by force by mounting an unsuitable toner cartridge or using a tool etc. Further, in addition to allow the fixing element to move, it is preferable that the fixing element is supported swayably. That is, if an undesired toner cartridge is set hence when the two stepped face do not match each other, unbalanced force acts on the fixing element. In this case the fixing element sways and prohibits the disengagement of the constraint on the locking element, which leads to improvement of the reliability for prevention of lock disengagement.

Once the shutoff lid has been open, the lid should be closed after toner supply. Since the opening and closing element is provided with an engaging portion which engages the locking element being in the releasing position, the engaging portion will engage the locking element, whereby the shutoff lid will be able to move by the locking element as the opening and closing element moves. Thus, it is possible to close the shutoff lid as the toner cartridge moves rearwards. Further, this engaging portion is used to urge the locking element towards the guide frame so that the locking element will become engaged.

Further, the sealing element covering the toner supply opening of the toner cartridge is attached to an attachment structure so that the sealing element can be peeled from the toner cartridge by separating the attachment structure from the toner cartridge. In this case, the releasing element or opening or closing element may be used as the attachment structure. When the releasing element or the opening and closing element is integrally but separably formed with the toner cartridge, it is possible to reduce the number of parts.

If the system is configured so that the sealing element can be peeled off only when the toner cartridge is correctly set to the toner supply position, it is possible to prevent contamination by toner around the toner entrance port. That is, the attachment structure should be allowed to be separated under the conditions where the shutoff lid has been completely opened and the toner cartridge has been attached at the correct position. Specifically, the attachment structure should be supported rotatably and be restricted from rotating before the toner cartridge reaches the toner supply position and be permitted to rotate when the cartridge reaches the toner supply position. With this configuration, the attachment structure can be separated when toner supply is allowed while the separation of the sealing element during movement can be prevented, thus it is possible to prevent toner leakage.

In the case where the shutoff lid for closing the toner entrance port of the toner hopper is opened and closed using a toner cartridge, the present invention allows the shutoff lid to be opened when a toner cartridge suited to the toner hopper is set. As a locking mechanism, the toner hopper includes a locking element for retaining the shutoff lid in the closed state and a fixing element for fixing the locking element. As the opening and closing mechanism for releasing the locked state by the locking mechanism, the toner cartridge includes a releasing element which moves the fixing element so as to allow the locking element to move as the toner cartridge moves forwards and an opening and closing element which moves the locking element so as to move the shutoff lid.

The faces of the fixing element and releasing element opposing each other when the toner cartridge is mounted on the toner hopper are formed with stepped portions so that the two stepped faces mesh with each other. When the toner cartridge moves forwards and the two elements mesh with each other, the fixing element is moved first by the releasing element, so as to cancel the constraint of the fixing element on the locking element. Then, the locking element is moved by the opening and closing element so as to cancel the locked state by the locking element, thus the shutoff lid can be opened.

The opening and closing element for moving the locking element which is being biased is formed with a stiffening rib. This enhances the rigidity of the opening and closing element, thus making it possible to prevent its deformation when abutted against the locking element. On one hand, the shutoff lid is formed with guide such as a groove, hole, etc. which receives the stiffening rib, so as to a guide the stiffening rib as the toner cartridge moves. By this arrangement, the opening and closing element is positioned relative to the shutoff lid, whereby the opening and closing element is exactly positioned relative to the locking element, thus making it possible to prevent malfunction of the locking mechanism.

One end of a sealing element covering the toner supply opening is attached to the releasing element. The releasing element is provided for the toner cartridge body so that it can be separated by bridges. In order to position the releasing element at a position where it can be separated when the toner cartridge body is set in the toner supply position, a restraining rib is provided for the toner cartridge body. This restraining rib comes into contact with the guide frame, so as to position the releasing element, thus making it possible to positively act breaking force on the bridges and hence easily break off the bridges when the releasing element is turned. As a result, the releasing element can be easily separated. At this point, a slack is created on one side of the sealing element and the end is temporally tacked at the toner cartridge body or releasing element, so that the tension of the sealing element will not cause any disturbance when the releasing element is separated. Thus, this configuration allows for smooth separation of the releasing element.

Further, a contact portion opposing the guide frame is formed in the releasing element so that it will abut the guide frame when the releasing element is rotated in the toner supply position. In this arrangement, the contact portion functions as the fulcrum so as to act a leverage force on the bridges. Thus, it is possible to break off the bridges with a minimum force and realize smooth separation of the releasing element.

In order to prevent the releasing element from being separated due to accidental breakdown at the bridges, sub-bridges having a smaller cross section than that of the bridges may and should be formed. Since these sub-bridges break off before the bridges when the releasing element is rotated, the releasing element can be turned about the bridges. Therefore, provision of sub-bridges will not cause any disturbance when the releasing element is separated.

When the releasing element is separated in the toner supply position, the bridges on the left and right arranged on an axis are twisted about the axis and broken off by the rotation of the releasing element. At this point, projections may and should be formed symmetrically on the left and right on the underside of the releasing element so that balanced force will act on the bridges on the left and right. When the releasing element is turned, the left and right projections come into contact with the shutoff lid but the front edge of the releasing element is kept out of contact with the shutoff lid. Therefore, even if the release element has a front part with a stepped face, no contact with the shutoff lid occur so that it is possible to act uniform force on the bridges, which leads to smooth separation of the releasing element.

In the case where the shutoff lid for closing the toner entrance port of the toner hopper is opened and closed using a toner cartridge, the present invention allows the shutoff lid to be opened when a toner cartridge suited to the toner hopper is mounted. As a locking mechanism, the toner hopper includes a locking element for retaining the shutoff lid in the closed state and a fixing element for fixing the locking element. As the opening and closing mechanism for releasing the locked state by the locking mechanism, the toner cartridge includes a projected abutment which moves the fixing element so as to allow the locking element to move when the toner cartridge body is moved forwards and a switching portion which moves the locking element so as to move the shutoff lid.

The engagement of the projected abutment of the toner cartridge body with the fixing element releases the locked state and opens the shutoff lid. When a cartridge having a dissimilar front face or an improper toner cartridge having an imitated front face is mounted, the configuration of the invention will not permit the projected abutment to mesh the fixing element, so that the lock cannot be released easily and hence the shutoff lid is prevented from being opened. This contributes improvement of the reliability of the locking mechanism.

Since the projected abutment is located at a retracted position with respect to the front edge of the toner cartridge body, or simply since no projected abutment is present in the front face, the abutment will be protected from being deformed or damaged even if the toner cartridge is handled roughly.

Since a multiple number of projected abutments, at least two on the left and right, are formed on the front side of the toner cartridge body, it is possible to positively move the fixing element. Since the fixing element can be moved in parallel, this configuration is effective in releasing the lock reliably, especially when the locking devices are arranged on both the left and right. Here, if an improper toner cartridge having a different number of projected abutments or a different geometrical arrangement of projected abutments is used, the fixing element moves in a wrong manner so that it is impossible to release the lock, thus making it possible to reject improper toner cartridges.

DESCRIPTION OF THE PREFERRED EMBODIMENTS

Figure 1:
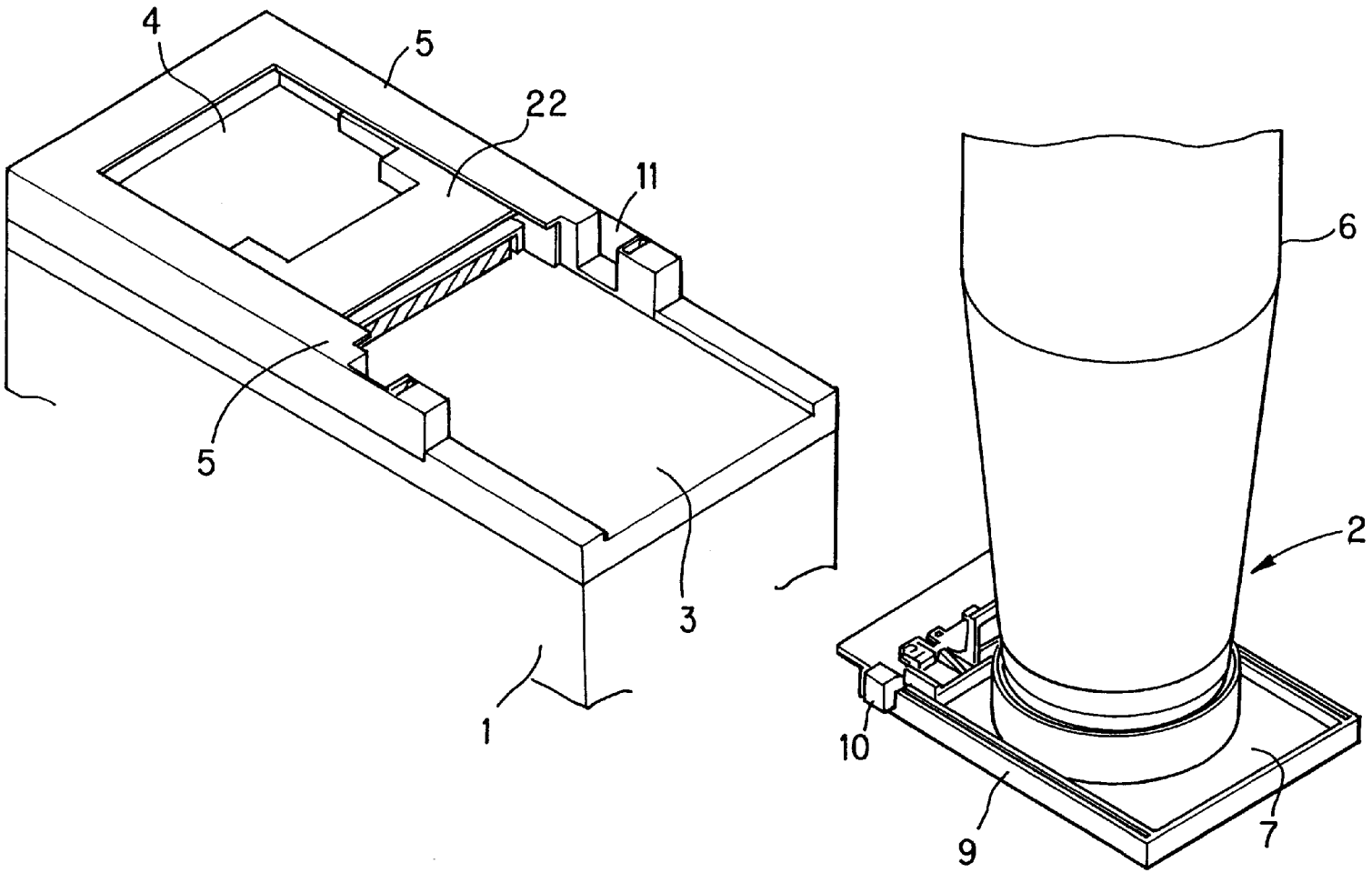
FIG. 1 is a perspective view showing a toner supply system in accordance with one embodiment of the present invention.
Figure 2:
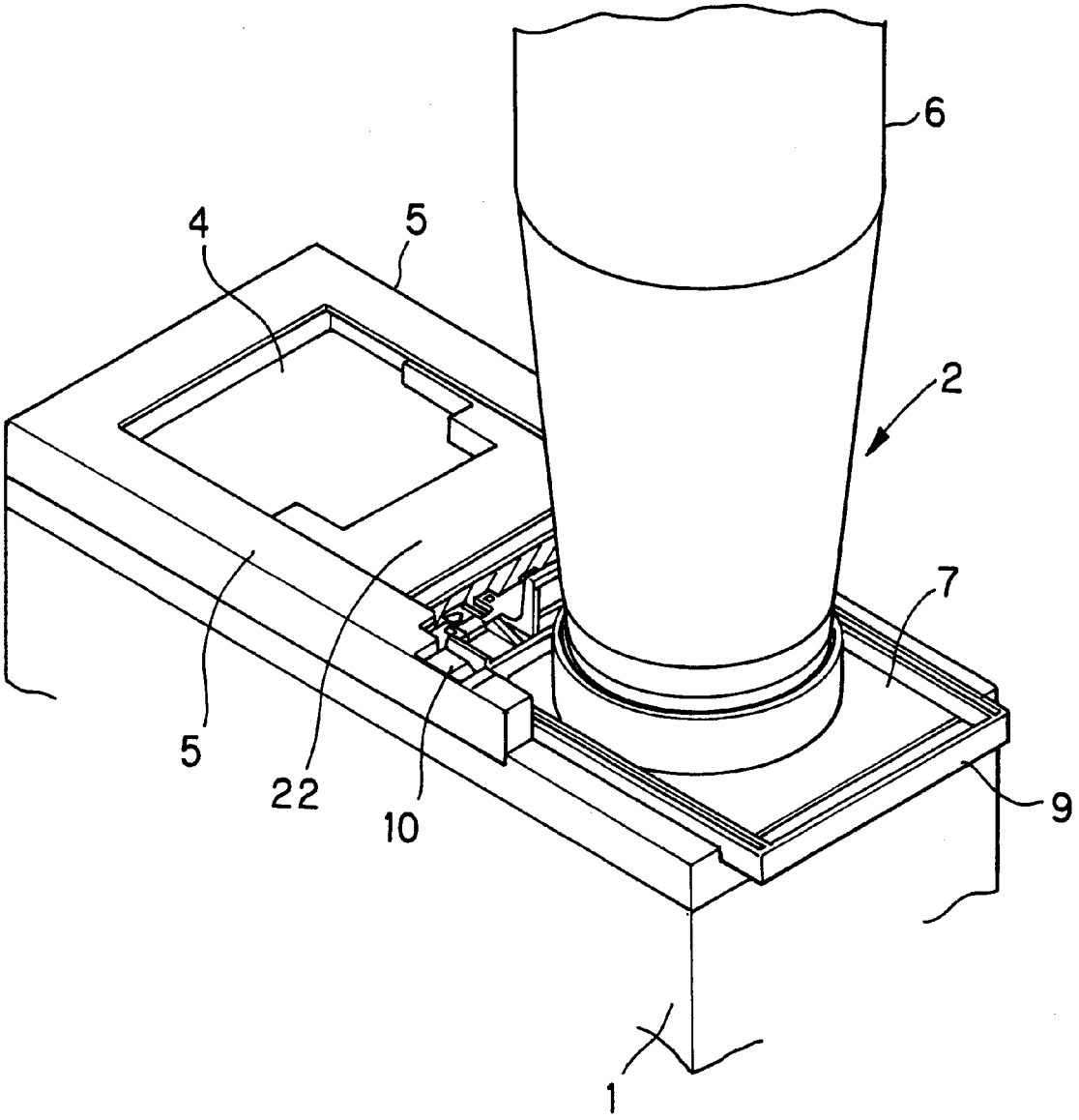
FIG. 2 is a perspective view showing a toner cartridge placed on a toner hopper.
Figure 3B:
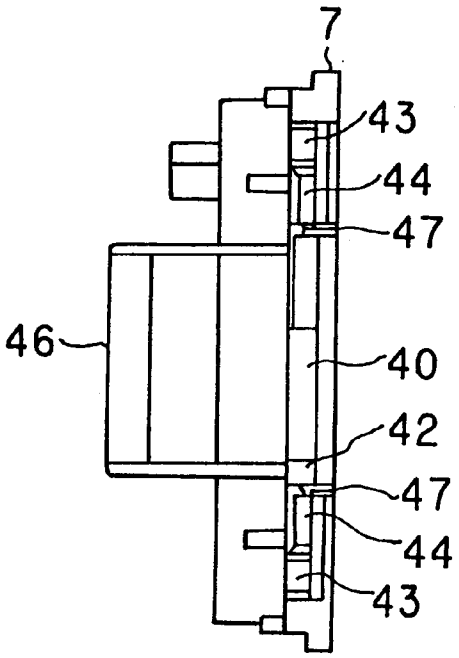
FIGS. 3A and 3B are plan and side views showing a bottle slider, respectively.
Figure 3A:
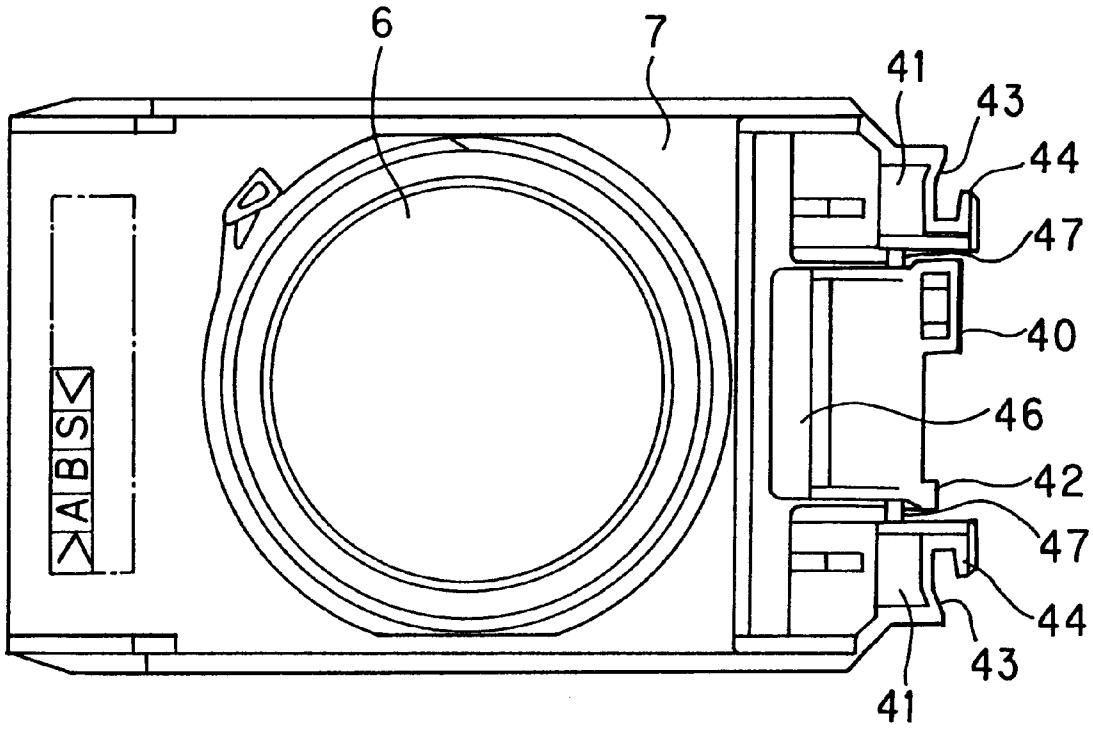
Figure 4B:
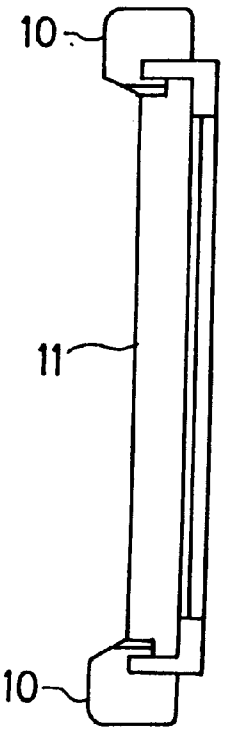
FIGS. 4A and 4B are plan and side views showing a cartridge cover, respectively.
Figure 4A:
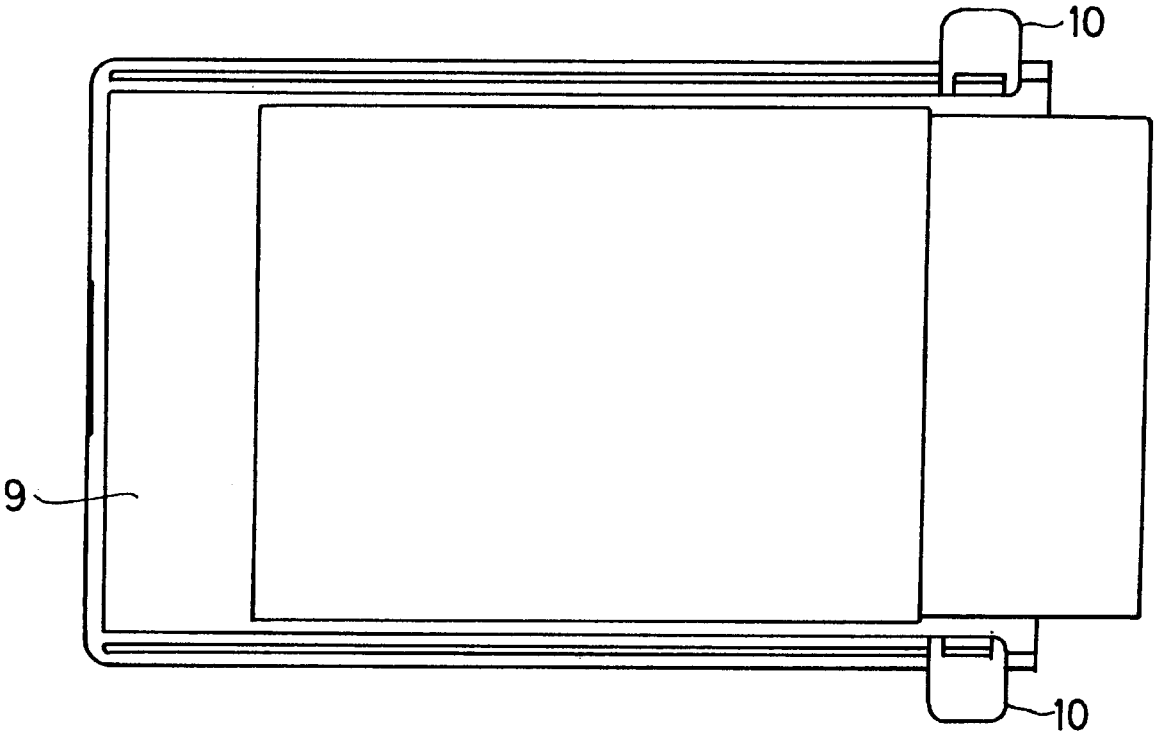

As shown in FIGS. 1 and 2, a toner supply system of one embodiment of the present invention is for supplying the toner from a toner cartridge 2 to a toner hopper 1 arranged in an image forming apparatus such as a copier etc., through a toner entrance port 1*a*. Toner hopper 1 has a mount 3 on which toner cartridge 2 is placed and the toner entrance port on the top surface thereof. Toner hopper 1 further has a shutoff lid 4 arranged so as to be openable and closable and a guide frame 5 arranged along the walls defining the toner entrance port for guiding shutoff lid 4 in the opening and closing directions . These opening and closing directions are assumed as the front and rear directions and the direction in which shutoff lid 4 is made open is assumed as the front side. The direction perpendicular to the front and rear directions will be called the left to right direction.

Toner cartridge 2, as shown in FIGS. 3A and 3B through FIGS. 7A, 7B and 7C, includes a toner bottle 6, a bottle slider 7 which abuts shutoff lid 4 so as to open or close the lid. Bottle slider 7 is integrally formed around the opening portion of toner bottle 6. Bottle slider 7 is removably fitted to a cartridge cover 9 that closes a toner supply opening 8. A pair of positioning pieces 10 are formed on the side surfaces of cartridge cover 9. These positioning pieces engage positioning holes 11 on mount 3 of toner hopper 1, thus enabling toner cartridge 2 to be positioned as well as enabling toner bottle 6 and bottle slider 7 to integrally move forward and rearward along cartridge cover 9 and guide bottle slider 7 to a guide frame 5. Therefore, cartridge cover 9 has the positioning function and the guiding function when toner cartridge 2 is fitted to toner hopper 1.

Figure 8B:
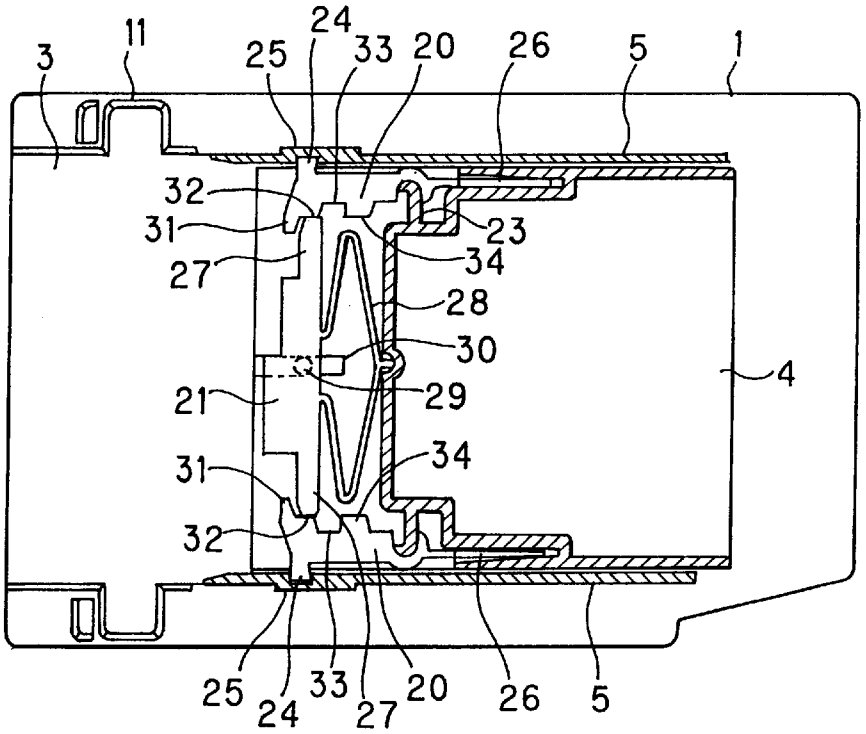
FIG. 8B is a plan view showing a locking mechanism.
Figure 8A:
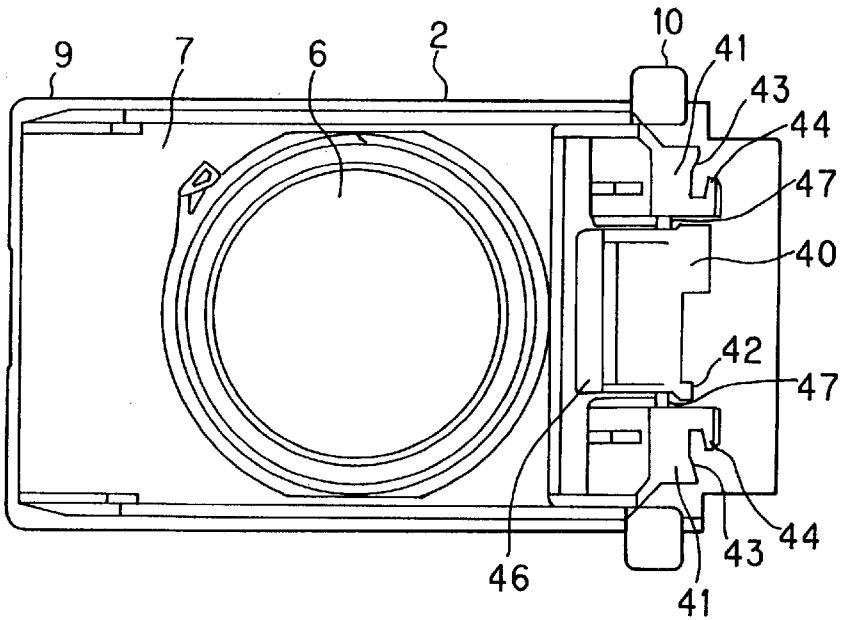
FIG. 8A is a plan view showing an opening and closing mechanism.

Shutoff lid 4 that opens and closes the toner entrance port has a locking mechanism in order to prohibit itself from being opened except when toner cartridge 2 of the predetermined type is attached for toner supply. The locking mechanism includes, as shown in FIGS. 8A and 8B, a pair of locking elements 20 arranged over the top surface of shutoff lid 4 for keeping shutoff lid 4 in its closed state and a fixing element 21 for fixing locking element 20. These are enclosed by a cover 22 for shutoff lid 4, to thereby keep them out of sight from the outside. Accordingly, the locking mechanism is protected from user's forcible release of the locking mechanism, by inserting a tool etc., to open shutoff lid 4. Thereby it is possible to avoid unnecessary troubles due to contamination of dust, dirt and other foreign matter into toner hopper 1.

Locking element 20 has a curved portion in its center and is supported at that portion by a support pin 23 formed on shutoff lid 4 so that the rear part can sway about the center to the left and right. An engaging claw 24 projected outward is formed on the outer surface of the rear part while guide frame 5 has a cutout notch 25 formed opposing the engaging claw 24. The front part of the locking element is formed of a leaf spring 26 so that it is held by the side part of shutoff lid 4, disallowing the locking element to slip out from shutoff lid 4 whilst urging engaging claw 24 outwards. Accordingly, locking element 20 is swayed between the engaging position at which engaging claw 24 engages guide frame 5 and the disengaged position at which engaging claw 24 moves inward and is separated from guide frame 5. Therefore, in the engaged position, shutoff lid 4 cannot be moved or made open, while in the disengaged position the lid can be moved or opened and closed. In this embodiment, locking elements 20 are arranged on both sides, left and right, but arrangement of locking element 20 on one side only can produce the desired effect.

Fixing element 21 is composed of a bearing portion 27 that abuts the inner surfaces of locking elements 20 so as to keep locking elements 20 at their engaged positions and an elastic portion 28 that elastically supports bearing portion 27 movable forwards and rearwards. Bearing portion 27 is arranged between two locking elements 20 on both sides over the top surface of shutoff lid 4, and has outer facets on both the left and right projected outwards. These projected portions are beveled on the rear side so that they are tapered toward the ends. The rear side of bearing portion 27 is formed with a stepped portion.

Elastic portion 28 is a leaf spring integrally formed with bearing portion 27 and its front end is fitted to the wall surface of cover 22. This elastic portion 28 urges bearing portion 27 rearwards so as to give an urging force for fixing locking elements 20. A pin-like spindle 29 is planted from the underside of bearing portion 27 at its center with respect to the left to right direction while a guide slot 30 that extends fore and aft and allows insertion of spindle 29 is formed on the upper surface of shutoff lid 4. As spindle 29 moves along this guide slot 30, the movement of bearing portion 27 is limited. The guide for guiding the bearing portion 27 may be formed so that a pin planted on shutoff lid 4 and a guide slot loosely receiving the pin may be formed in bearing portion 27.

Here, bearing portion 27 is arranged so as to move along the inner surfaces of locking elements 20 opposed thereto. The inner surface of each locking element 20 has stepped portions, i.e., projections and indentations so as to vary the position of locking element 20 in accordance with the movement of bearing portion 27. In each locking element 20, a hooking portion 31 projected inwards, an abutment portion 32, a spacing portion 33 and an interference portion 34 are formed in this sequential order from the rear to the front.

As the outer face of bearing portion 27 abuts this abutment portion 32, locking element 20 is kept in the engaging position. Spacing portion 33 is arranged so as to provide a space which avoids abutment of the locking element against bearing portion 27, whereby constraint by bearing portion 27 is avoided to allow movement of each locking element 20. Illustratively, when bearing portion 27 is set at its rearmost position by the urging force of elastic portion 28, bearing portion 27 opposes abutment portions 32 so as to restrict the movement of locking elements 20 and hence keep them at their engaged positions. As bearing portion 27 moves opposing the urging force so that bearing portion 27 opposes spacing portions 33, locking elements 20 are permitted to move inwards to release the engagement. Interference portion 34 is positioned on the front side of spacing portion 33 so as to abut bearing portion 27. That is, when bearing portion 27 has passed spacing portions 33, the interference positions restrict the movement of locking elements 20. In connection with the above, hooking portion 31 has an inclined face correspondent to the inclined face of bearing portion 27. Further, the rear face of locking element 20 has an inclined surface formed so that its inner side projects rearwards.

Toner cartridge 2 has an opening and closing mechanism to allow release of the above locking mechanism. That is, arranged in the front part of bottle slider 7 are a releasing element 40 which urges fixing element 21 forwards to permit movement of locking elements 20 when toner cartridge 2 is moved forwards and opening and closing elements 41 which move locking elements 20 inwards so as to allow shutoff lid 4 to move.

Releasing element 40 has a stepped, projected and indented face on the front side so that its projected face abuts the indented face of bearing portion 27. The projected amount from the indented surface to the projected surface in releasing element 40 is specified to be greater than the projected amount from the indented surface to the projected surface in bearing portion 27 so that the indented face of releasing element 40 will not abut the projected face of bearing portion 27 when the projected face of releasing element 40 abuts the indented face of bearing portion 27. Further, a projection 42 is formed at a position of the indented face of releasing element 40 so that the releasing element will come into contact at least two points with the stepped face of bearing portion 27 to push bearing portion 27 with equal forces at both right and left sides. Here, the stepped faces on both the elements need not snuggly fit to each other and should be dimensioned so that they work in the order mentioned later.

Figure 9B:
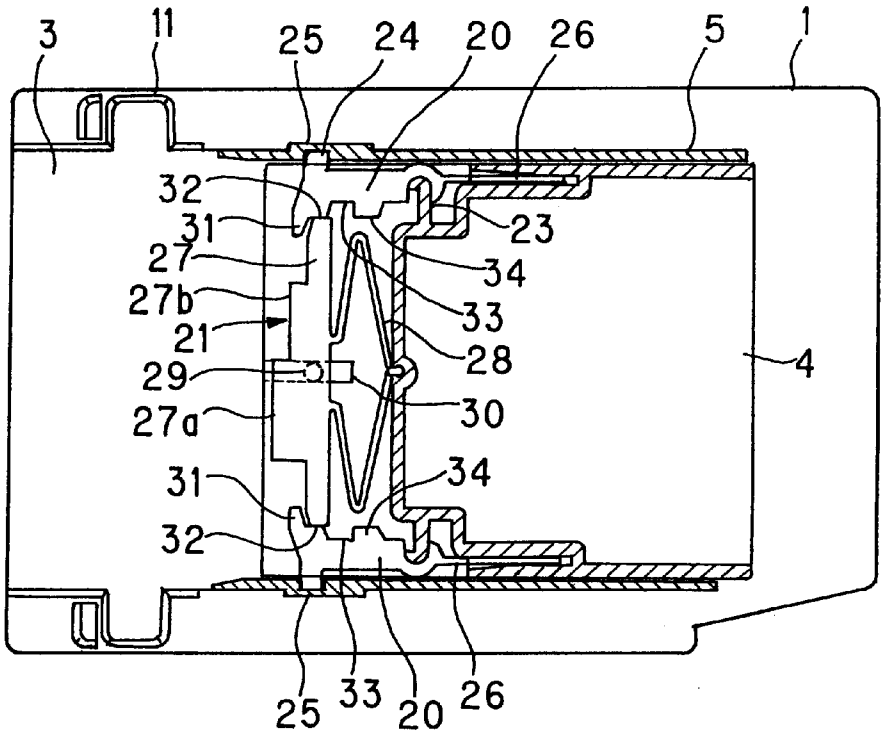
FIG. 9B is a plan view showing a locking mechanism.
Figure 9A:
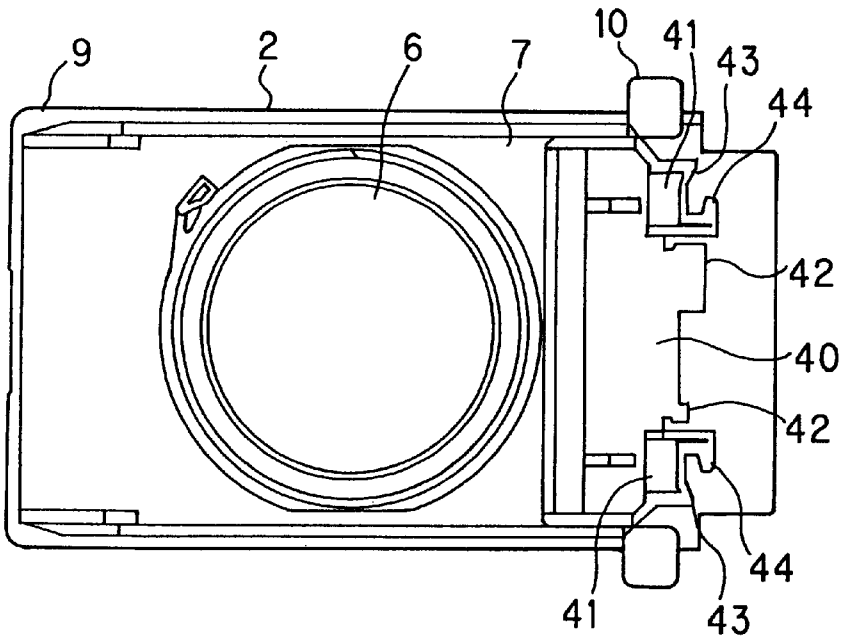
FIG. 9A is a plan view showing an opening and closing mechanism.

As shown in FIGS. 9A and 9B, releasing element 40 has a pair of projected abutments (projections) 42 at the right and left, forming a stepped, projected and indented face. Left and right projected abutment 42 have different projected amounts; left projected abutment 42 projects greater than right projected abutment 42. Therefore, left projected abutment 42 is able to abut an indented face 27*b* of fixing element 21 and right projected abutment 42 is able to abut a projected face 27*a* of fixing element 21 so the releasing element will come into contact at least two points with the stepped face of bearing portion 27 to push bearing portion 27 with equal forces at both right and left sides. Here, the stepped portions on both the elements need not snuggly fit to each other and are dimensioned so that they work in the order mentioned later.

Opening and closing elements 41 are arranged on both the left and right sides of releasing element 40. Each opening and closing element 41 includes a switching portion 43 that abuts the rear face of locking element 20 and moves locking element 20 from the engaging position to the releasing position, and an engaging portion 44 that engages hooking portion 31 of locking element 20. Switching portion 43 is located behind the projected face of releasing element 40 with its front surface formed inclined correspondingly to the inclination of the rear face of locking element 20. As toner cartridge 2 moves forward, locking element 20 is pushed inwards by abutment of the inclined face of switching portion 43 against the inclined rear face of locking element 20.

Opening and closing elements 41 are arranged on both the left and right sides of releasing element 40. Each opening and closing element 41 includes a switching portion 43 that abuts the rear face of locking element 20 and moves locking element 20 from the engaging position to the releasing position, and an engaging portion 44 that engages hooking portion 31 of locking element 20. Switching portion 43 is located behind the projected abutment 42 on the left with its front surface formed inclined correspondingly to the inclination of the rear face of locking element 20. As toner cartridge 2 moves forward, locking element 20 is pushed inwards by abutment of the inclined face of switching portion 43 against the inclined rear face of locking element 20.

Figure 10A:
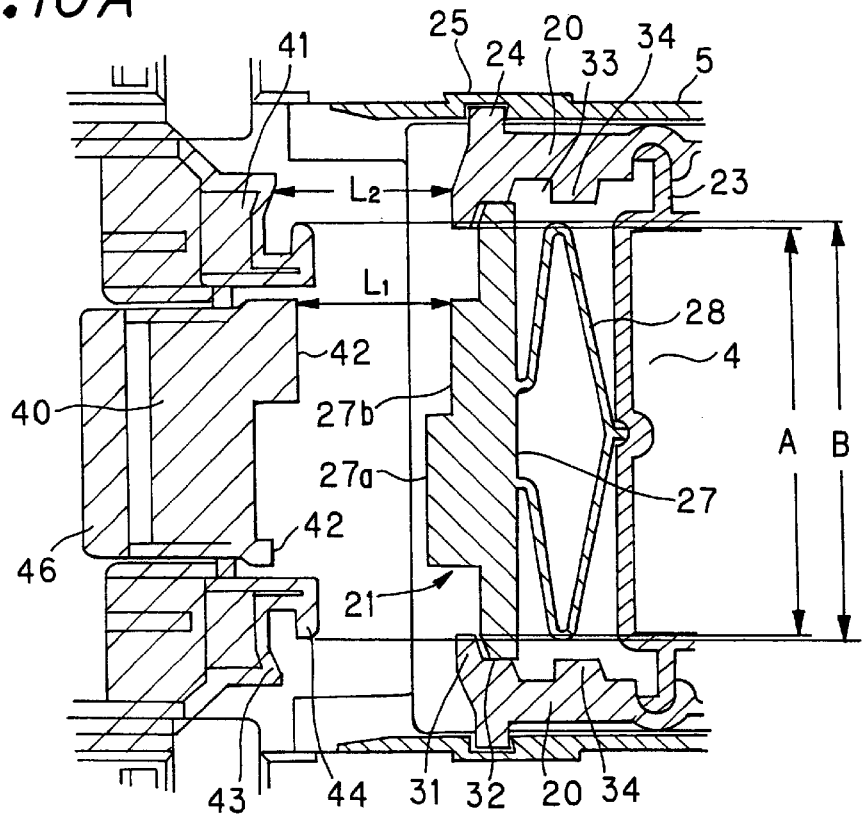
FIG. 10A is a partially enlarged view showing a state where a toner cartridge is placed on a toner hopper and FIG. 10B is a partially enlarged view showing a state where a toner cartridge abuts a fixing element.

Engaging portion 44 is located at an inner position with respect to switching portion 43 and ahead of switching portion 43 and the projected face of releasing element 40, and hooks outwards and sidewards. The front face of this engaging portion 44 is tapered while the rear face is formed with an inclined surface correspondent to the inclined surface of hooking portion 31. Here, the outer end face of engaging portion 44 is located at an outer position slightly closer to guide frame 5 with respect to the inner end face of hooking portion 31 when the locking element is in the engaging position, so that engaging portion 44 will necessarily engage hooking portion 31 when the locking element is set in the releasing position. More specifically, as shown in FIG. 10A, the distance B between the outer end faces of left and right engaging portions 44 is set slightly greater than the distance A between the inner end faces of left and right hooking portions 31. This arrangement allows hooking portion 31 to be caught between engaging portion 44 and switching portion 43 and prevents the engagement of opening and closing elements 41 with locking elements 20 from being undone when toner cartridge 2 is moved rearwards. Thus, it is possible to move shutoff lid 4 rearwards by locking elements 20 as toner cartridge 2 moves. The dimension of the overlap between engaging portion 44 and hooking portion 31 is determined so that engaging portion 44 can move and ride over hooking portion 31 while locking element 20 is in the engaging position.

Engaging portion 44 is located at an inner position with respect to switching portion 43 and ahead of switching portion 43 and projected abutment 42 of releasing element 40, and hooks outwards and sidewards. The corner at the front face of this engaging portion 44 is beveled or tapered while the rear face is formed with an inclined surface correspondent to the inclined surface of hooking portion 31. That is, the front face of engaging portion 44 is the front end of bottle slider 7 while the projected abutment 42 is located behind this front end.

Here, the outer end face of engaging portion 44 is located at an outer position slightly closer to guide frame 5 with respect to the inner end face of hooking portion 31 while the locking element is in the engaging position, so that engaging portion 44 will necessarily engage hooking portion 31 while the locking element is at the releasing position. More specifically, as shown in FIG. 10A, the distance B between the outer end faces of left and right engaging portions 44 is set slightly greater than the distance A between the inner end faces of left and right hooking portions 31. This arrangement allows hooking portion 31 to be caught between engaging portion 44 and switching portion 43 and prevents the engagement of opening and closing elements 41 with locking elements 20 from being undone when toner cartridge 2 is moved rearwards. Thus, it is possible to move shutoff lid 4 to be moved rearwards by locking elements 20 as toner cartridge 2 moves. The dimension of the overlap between engaging portion 44 and hooking portion 31 is determined so that engaging portion 44 can move and ride over hooking portion 31 while locking element 20 is in the engaging position.

Meanwhile, in toner cartridge 2, in order to avoid degradation of the characteristics of the toner stored therein due to moisture etc., as well as to prevent the toner from scattering outside toner hopper 1 when the toner is charged, the underside opening of bottle slider 7 is sealed with a film-like sealing element (not shown). This sealing element is applied to bottle slider 7 by thermo-bonding or any other method. When toner cartridge 2 has been set at the toner supply position and this seal is pulled out, the toner is charged from toner cartridge 2 into toner hopper 1.

As the arrangement for pulling sealing element 45, one end of sealing element 45 is fixed to the undersurface of releasing element 40 so that sealing element 45 will be peeled off when releasing element 40 is separated from bottle slider 7. A handle 46 is formed on the upper side of releasing element 40. That is, releasing element 40 functions as the attachment structure of sealing element 45.

Figure 11:
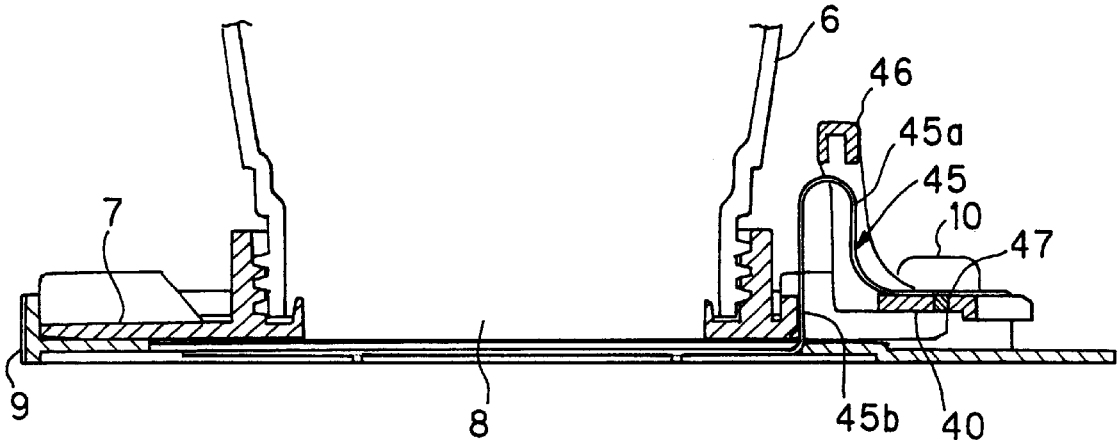
FIG. 11 is a view showing a sealing element.

For the fixture of sealing element 45, it is preferred that a slack 45*a* is formed on one side between the bottom of bottle slider 7 and the portion fixed to releasing element 40 as shown in FIG. 11. This slack 45*a* is temporally tacked at 45*b* to the side wall of bottle slider 7 so that the bonded surface is in parallel with the pulling direction and readily peeled. The presence of slack 45*a* prevents unnecessary forces from acting on releasing element 40 when sealing element 45 is removed, thus realizing smoothly separation of releasing element 40. Besides, temporal tacking of slack 45*a* of sealing element 45 prevents loss of the slack due to its being pulled while the toner cartridge 2 is moved.

Figure 12:
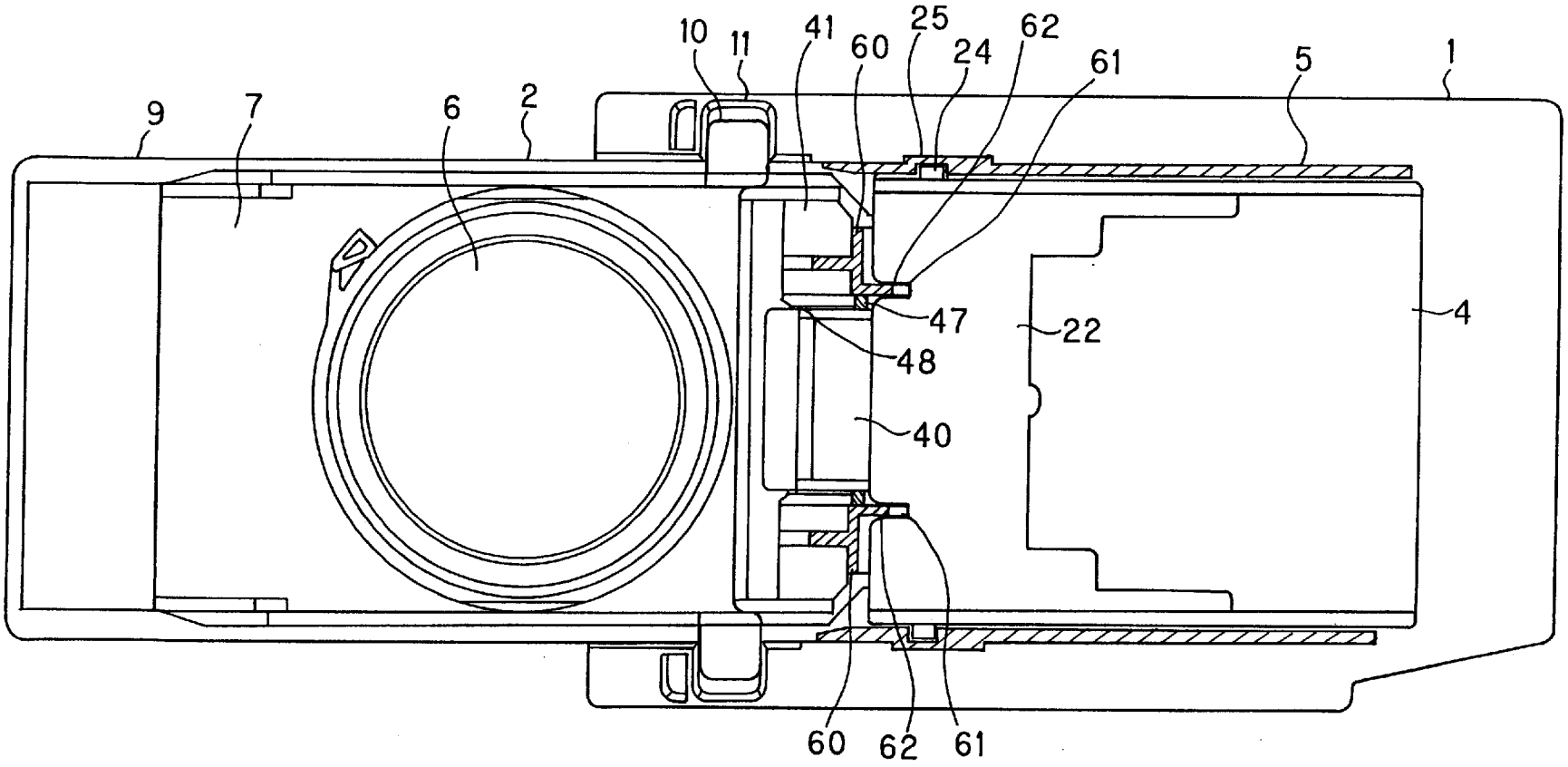
FIG. 12 is a plan view showing a toner supply system when opening and closing elements are guided by a shutoff lid.
Figure 13:
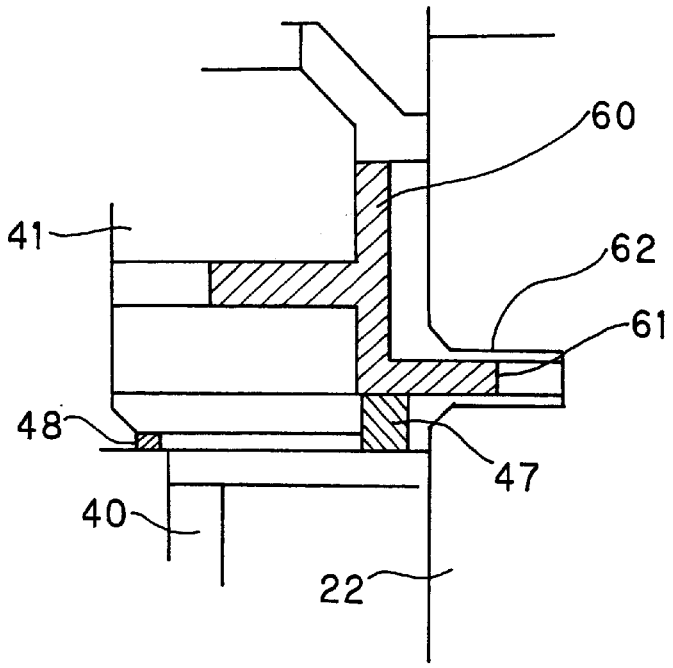
FIG. 13 is a partially enlarged view of FIG. 12.
Figure 14:
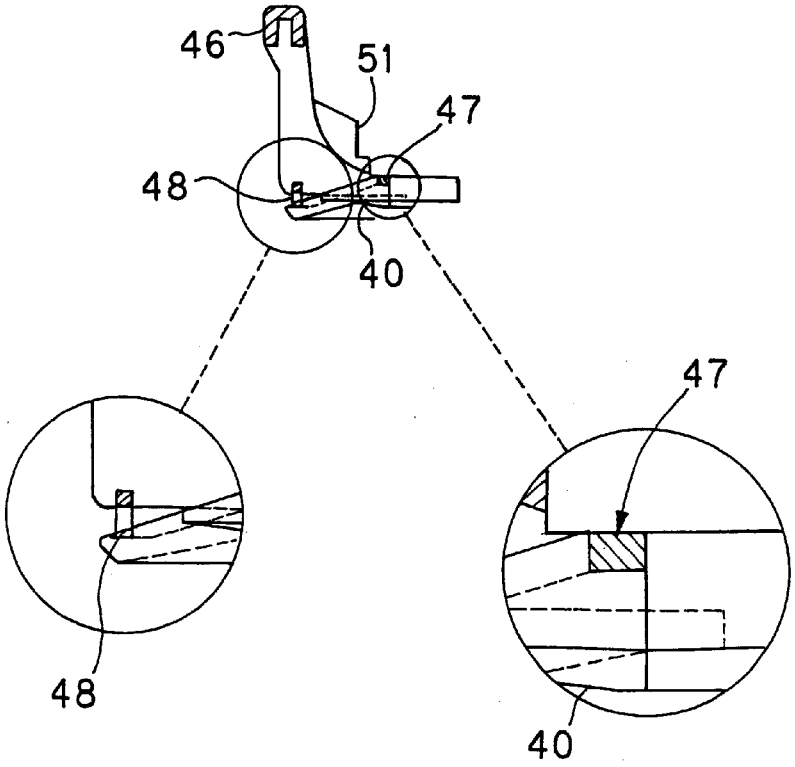
FIG. 14 is an illustration showing a bridge and a sub-bridge.

In order for releasing element 40 to be separated from bottle slider 7, bridges 47 and sub-bridges 48 are provided on both the left and right sides of releasing element 40 so as to connect the releasing element 40 to opening and closing elements 41, as shown in FIGS. 12 and 13. Sub-bridge 48 has a smaller cross section than bridge 47 as shown in FIG. 14 so that it breaks off easily compared to bridge 47. Thus, though releasing element 40 would be supported rotatably with respect to opening and closing elements 41 about bridges 47 which are aligned on an axis, the existence of sub-bridges 48 prevents releasing element 40 from accidentally rotating and separating from opening and closing elements 41. It should be noted that sealing element 45 is attached to opening and closing elements 41. In this case, the opening and closing elements function as the attachment structure.

As releasing element 40 is rotated about bridges 47 as the fulcrum by holding handle 46, sub-bridges 48 first break off and then bridges 47 break off so that releasing element 40 can be readily separated from bottle slider 7. That is, pulling handle 46 causes removal of releasing element 40 and removal of sealing element 45 from toner cartridge 2. In this way, once toner cartridge 2 has been used, the toner cartridge 2 with its sealing element 45 pulled out has no releasing element 40. Therefore, if this is attached again to toner hopper 1, it is impossible to open shutoff lid 4. In connection with toner cartridge 2, even if handle 46 is rotated when bottle slider 7 is mounted to cartridge cover 9, the front end of releasing element 40 is adapted to come into contact with cartridge cover 9. This configuration prevents separation of releasing element 40 as well as removal of sealing element 45 when the cartridge is not mounted to toner hopper 1.

Figure 15:
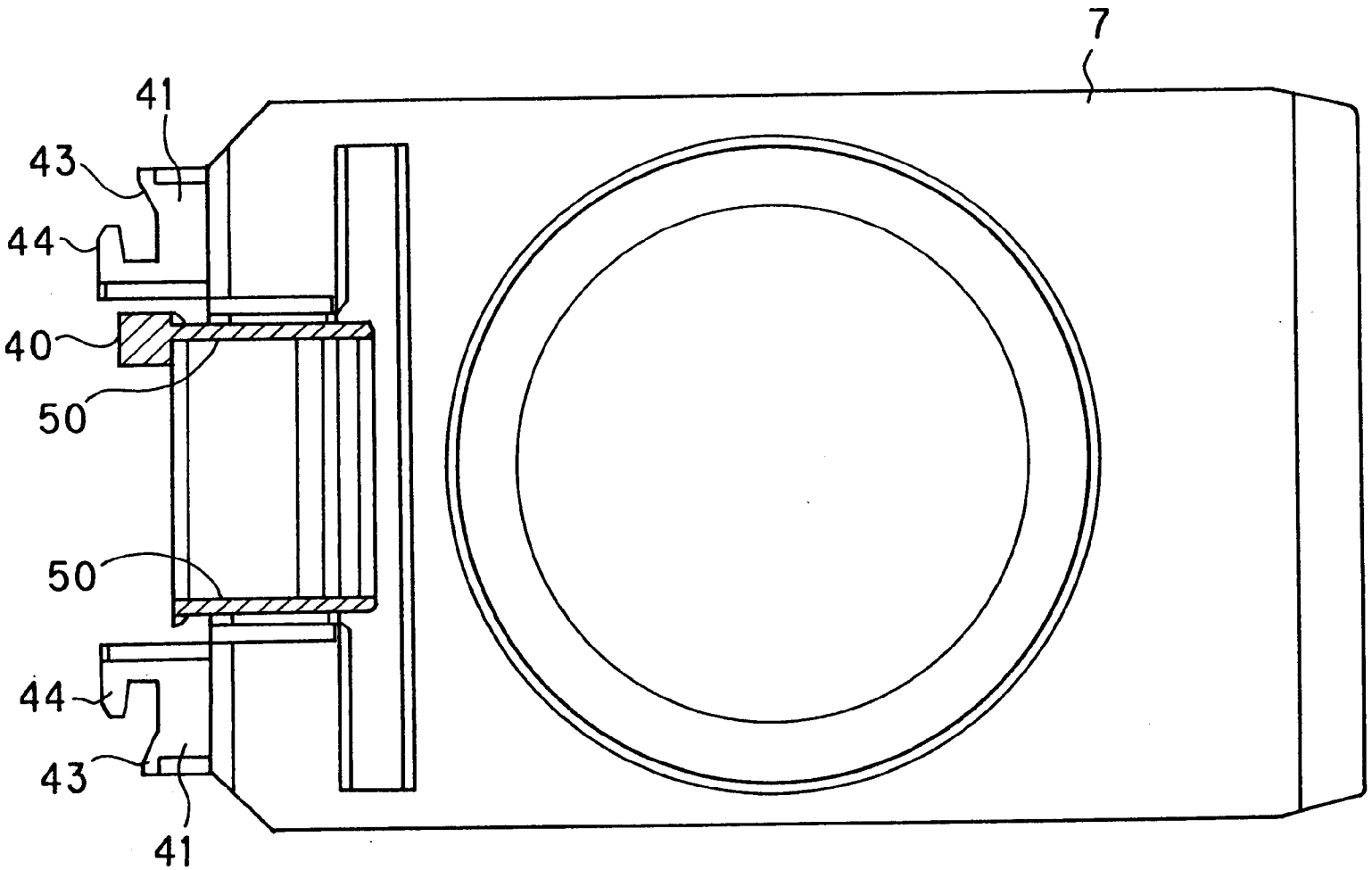
FIG. 15 is a bottom view showing a bottle slider.
Figure 16A:
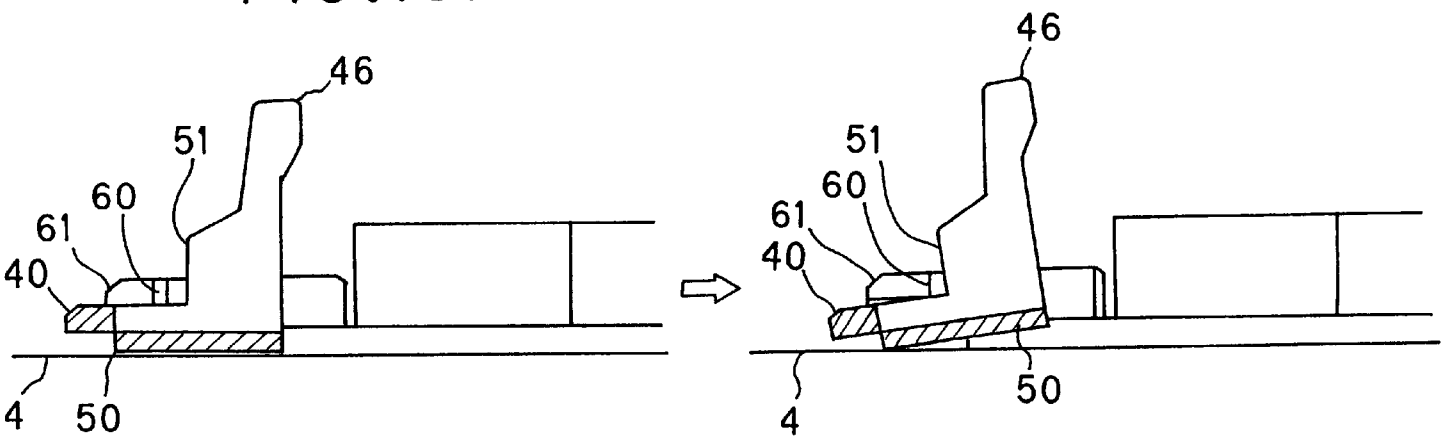
FIG. 16A is a view showing rotation of a releasing element having a projection and FIG. 16B is a view showing rotation of a releasing element without projections.
Figure 16B:
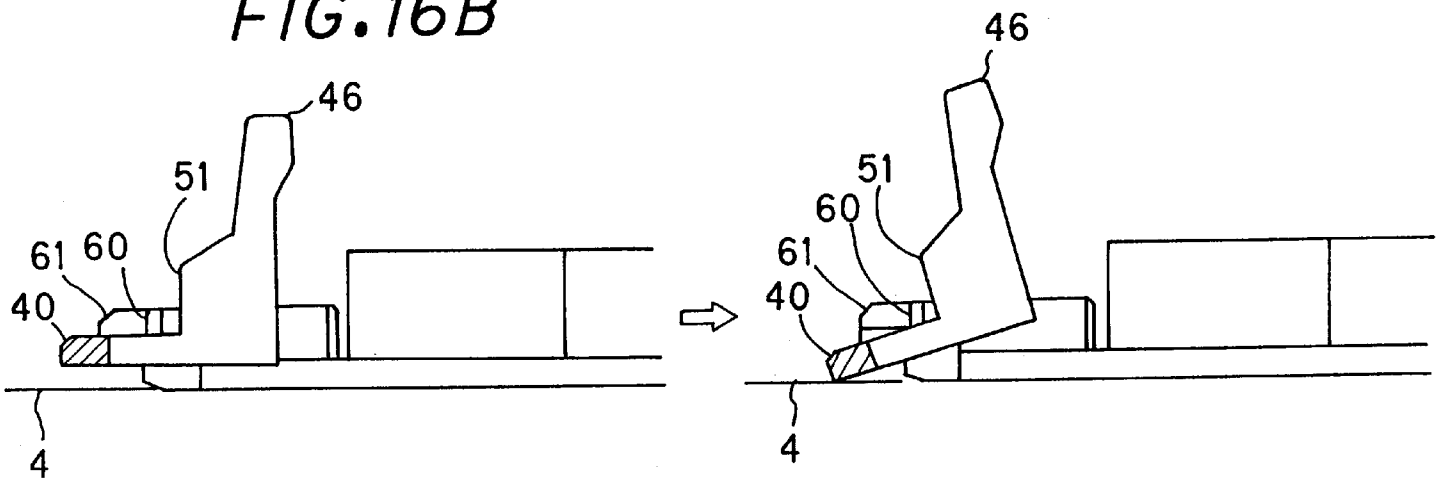

When releasing element 40 is separated at the toner supply position, bridges 47 are twisted about their axis by the rotation of releasing element 40 and break off. In this case, since the front part of releasing element 40 is formed with stepped portions, there might be a case where the urging force from the releasing element when it comes into contact with shutoff lid 4 will not act evenly on the left and right bridges 47. In order to make uniform the force on both the left and right bridges 47, a pair of projections 50 are formed on the underside of releasing element 40 symmetrically on the left and right sides, as shown in FIG. 15. With this arrangement, when releasing element 40 rotates and tilts to a degree, both the left and right projections 50 abut shutoff lid 4 while the front part of releasing element 40 will not come into contact with shutoff lid 4, as shown in FIG. 16A. As a result, balanced force acts on both sides of releasing element 40 so that uniform breaking force is applied on both bridges 47 and breaks them at the same time, allowing for smooth separation of releasing element 40. In contrast, when no projection 50 is present, as shown in FIG. 16B, as releasing element 40 rotates, the front part thereof abuts shutoff lid 4 on only one side with respect to the left and right direction. This disturbs correct rotation of releasing element 40 about bridges 47 but causes torsion with respect to the left and right direction, resulting in failure of a balanced breaking force to act on bridges 47 and break them.

Figure 5:
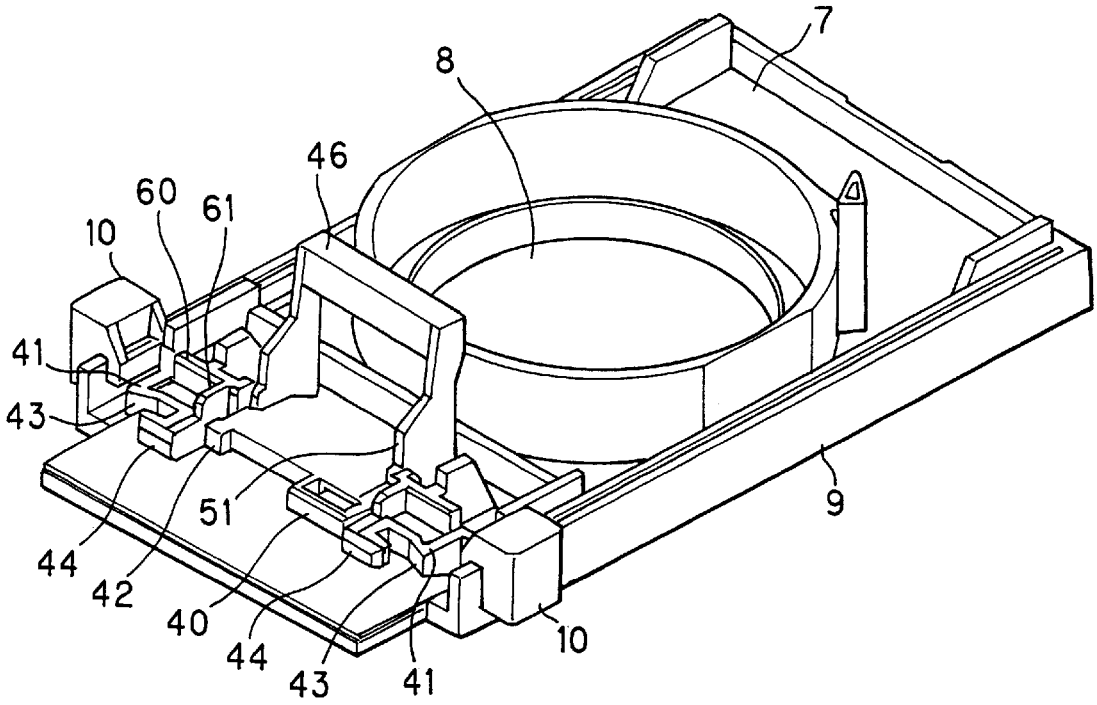
FIG. 5 is a perspective view showing a toner cartridge with its toner bottle omitted.
Figure 6:
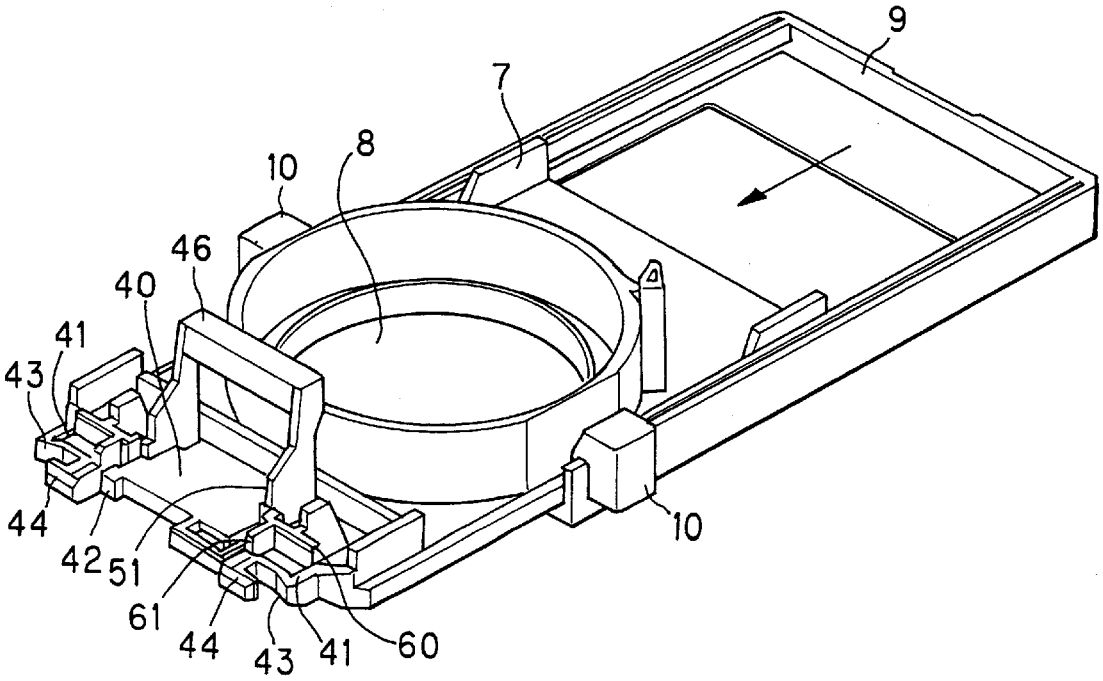
FIG. 6 is a perspective view showing a toner cartridge when the bottle slider is moved with its toner bottle omitted.
Figures 7A, 7B, 7C:
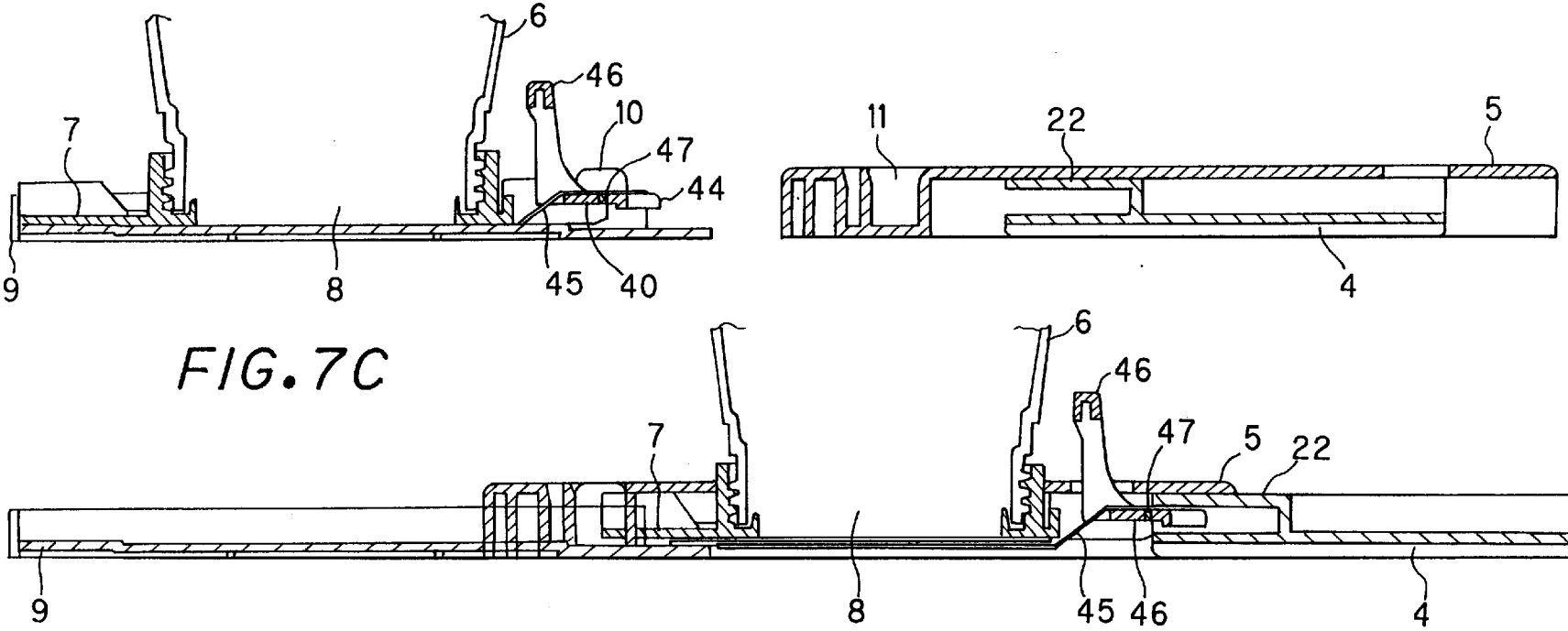
FIG. 7A is a sectional view showing an opening and closing mechanism.
FIG. 7B is a sectional view showing a shutoff lid.
FIG. 7C is a sectional view showing a toner cartridge moved along the top surface of a toner hopper.
Figure 17A:
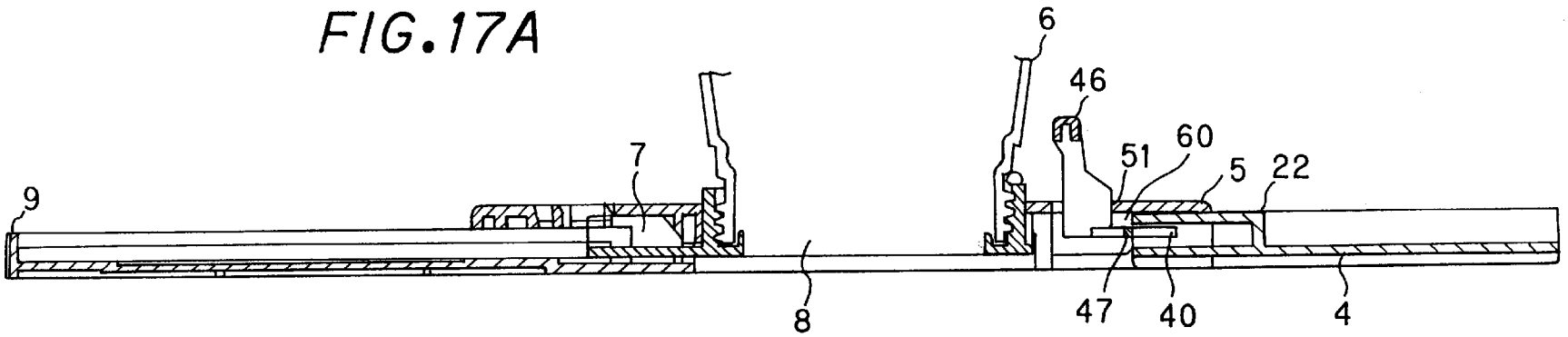
FIG. 17A is a view showing a releasing element in its unrotated position, at the toner supply position
Figure 17B:
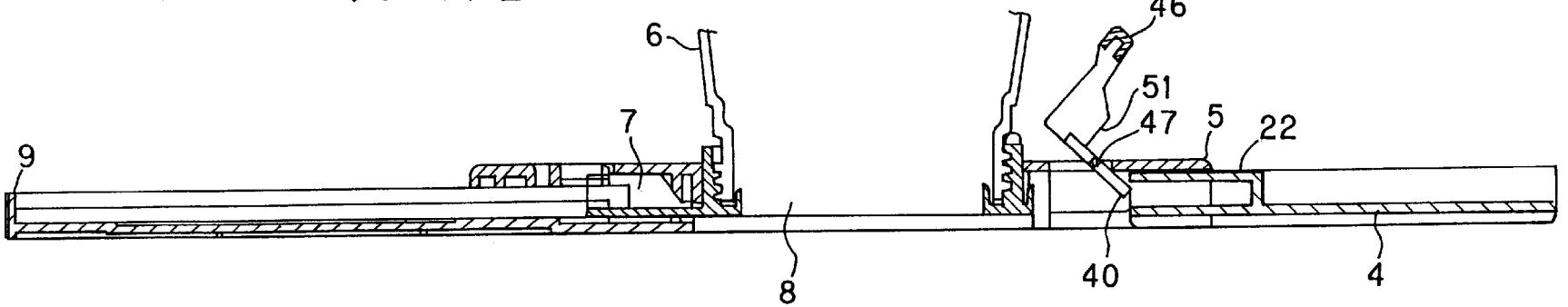
FIG. 17B is a view showing a releasing element in its separated state, at the toner supply position.

Further, in order to enable rotation of releasing element 40 with a minimum force, contact portions 51 which oppose guide frame 5 when the cartridge is set at the toner supply position are formed in releasing element 40. As shown in FIGS. 5 and 6, contact portions 51 are of a pair of ribs symmetrically formed on the left and right of upright parts of handle 46. As releasing element 40 rotates about bridges 47 as the fulcrum, contact portions 51 abut guide frame 5 as shown in FIGS. 17A and 17B. Because of the leverage principle, contact portions 51 serve as the fulcrum, handle 46 serves as the power point and bridges 47 serve as the point of application of force, so that bridges 47 can be broken with a minimum force.

In the above case, since part of releasing element 40 abuts guide frame 5, there is a fear that guide frame 5 may be damaged. To avoid this, releasing element 40 or bottle slider 7 is formed of a material softer than that of guide frame 5. For example, bottle slider 7 may be formed of ABS having a surface hardness of R90 in Rockwell scale and guide frame 5 may be formed of HI-PS (impact resistant polystyrene)

having a surface harness of M80 in Rockwell scale. With these specifications, it is possible to minimize damage to guide frame 5 when releasing element 40 abuts guide frame 5.

For further improvement of smooth separation of releasing element 40, it is necessary that the breaking force on bridges 47 effectively act. This can be realized by positively positioning bridges 47 when the cartridge is set at the toner supply position. For this purpose, restraining ribs 60 are formed in bottle slider 7. As shown in FIGS. 12 and 13, a pair of restraining ribs 60 are formed symmetrically on opening and closing elements 41 on both the left and right sides along the extensions of the axial line of bridges 47 so as be able to move and slide along guide frame 5. When bottle slider 7 reaches the toner supply position, restraining ribs 60 are in contact with the inner surface of guide frame 5 so as to restrain the vertical movement of bridges 47. Positioning with respect to the front to rear direction is assured by the toner supply position. In this way, bridges 47 are placed at fixed positions so that the positional relation between contact portions 51 of releasing element 40 and guide frame 5 is fixed, thus making it possible for the breaking force to act effectively on the left and right bridges 47 without any loss.

A stiffening rib 61 which extends forwards is formed integrally with each restraining rib 60. This enhances the rigidity of opening and closing element 41 and prevents its deformation when the opening and closing element abuts locking element 20. Cover 22 of shutoff lid 4 is formed with grooves as guides 62 which have stiffening ribs 61 fitted therein. Alternatively, instead of the grooves, upright walls may be formed so as to guide stiffening ribs 61 therealong. Since stiffening ribs 61 are guided by and fitted into guides 62 as bottle slider 7 moves, opening and closing elements 41 are positioned with respect to shutoff lid 4. Accordingly, each opening and closing element 41 is correctly positioned to locking element 20, thus making it possible to prevent malfunction of the locking mechanism. For merely guiding bottle slider 7, ribs capable of mating guides 62 may be formed in releasing element 40.

Figure 18:
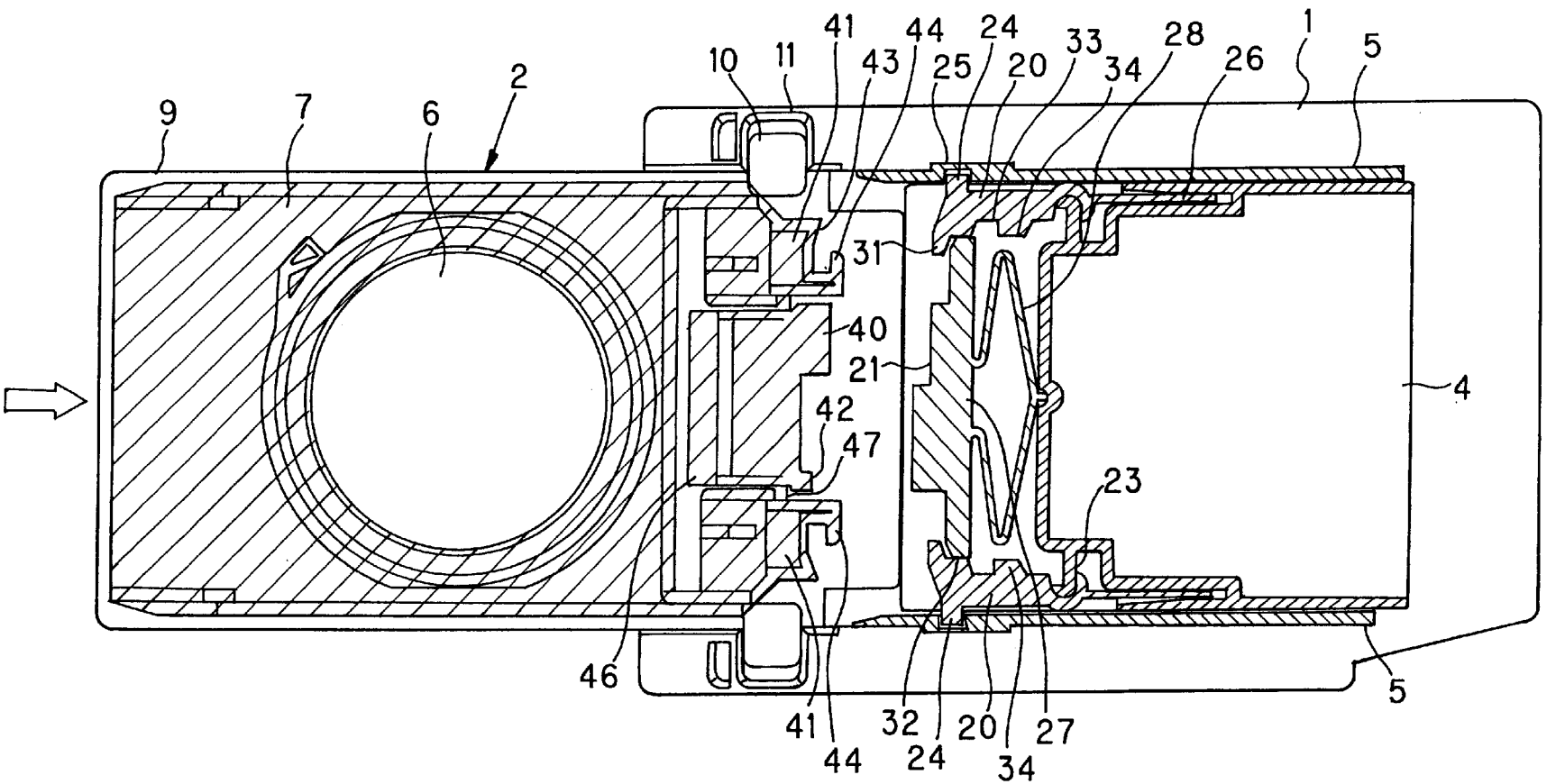
FIG. 18 is a plan view showing a toner supply system when a toner cartridge is placed on a toner hopper.

Next, the toner supply operation from toner cartridge 2 having the above configuration to toner hopper 1 will be described. Referring first to FIG. 18, toner cartridge 2 is placed on mount 3 on the top of toner hopper 1 to position cartridge cover 9. In this state, as shown in FIG. 10A, the distance L1 between the indented face of bearing portion 27 and the projected face of releasing element 40 is specified to be shorter than the distance L2 between the rear face of locking element 20 and switching portion 43 of opening and closing element 41 so that releasing element 40 abuts bearing portion 27 before switching portions 43 abut locking elements 20.

Figure 19:
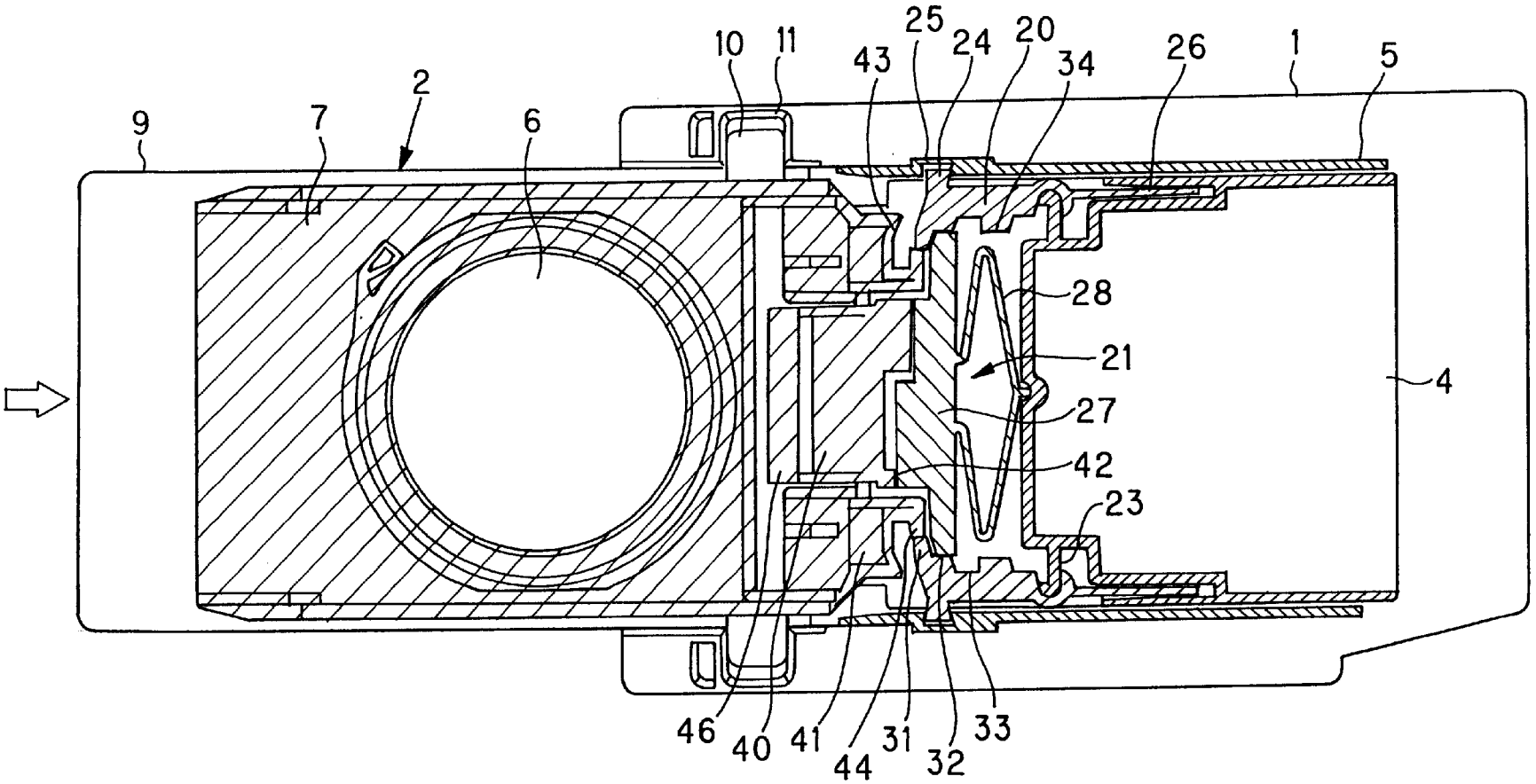
FIG. 19 is a plan view showing a toner supply system when a toner cartridge abuts a fixing element.

Then, as bottle slider 7 of toner cartridge 2 is made to advance as it is abutted on the top surface of toner hopper 1, bottle slider 7 moves along cartridge cover 9 and the front part of releasing element 40 becomes inserted into cover 22 of shutoff lid 4. With this insertion, stiffening ribs 61 of opening and closing elements 41 mate guides 62 of shutoff lid 4, whereby each component is set in place. A further advancement causes the projected face of releasing element 40 to abut the indented face of bearing portion 27 and projection 42 to abut the projected face of bearing portion 27, as shown in FIG. 19. At this point, switching portions 43 have yet to abut locking elements 20. Engaging portions 44 abut corresponding hooking portions 31 slightly before the abutment of releasing element 40 on fixing element 21. In this case, hooking portion 31 is pushed by engaging portion 44 and flexes outwards and sidewards while engaging portion 44 itself also flexes, whereby it is possible to avoid blockage of movement of bottle slider 7 due to collision therebetween.

Figure 10B:
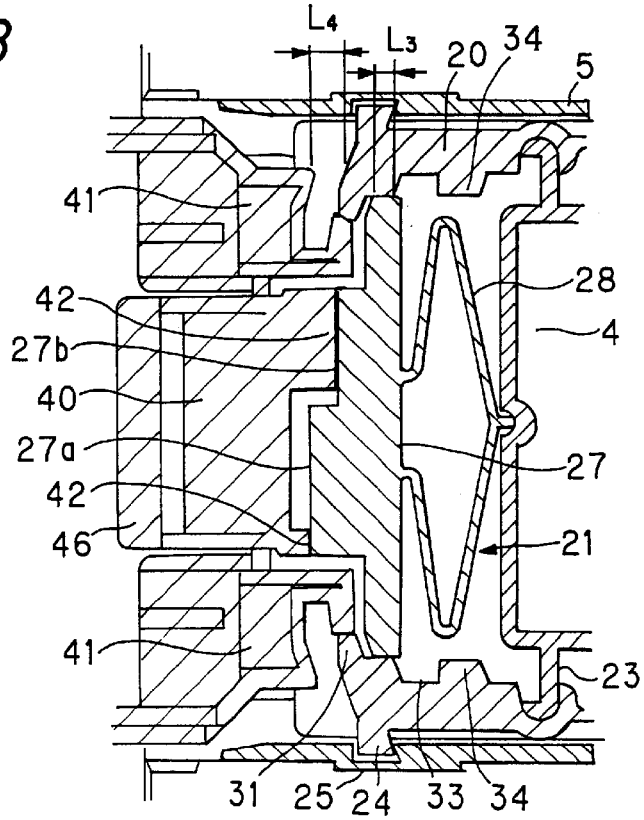

When releasing element 40 has abutted bearing portion 27 with their stepped surfaces mated with each other, the distance L3 from the outer end face of bearing portion 27 abutting on abutment portion 32 of locking element 20 to spacing portion 33 is specified to be smaller than the distance L4 from the rear face of locking element 20 to switching portion 43, as shown in FIG. 10B. Here, if distance L3 is greater than distance L4, bearing portion 27 have yet to reach spacing portion 33 when switching portion 43 comes to abut locking element 20. Hence, at least part of bearing portion 27 abuts on each abutment portion 32, so that bearing portion 27 restrains locking elements 20 from moving inwards. Therefore, the forward movement of opening and closing elements 41 are prohibited, thus disallowing shutoff lid 4 to be released. If the bottle slider is forcibly advanced, there is a risk of the parts involved being broken. In conclusion, smooth release of shutoff lid 4 needs the above positional relationship.

Figure 20:
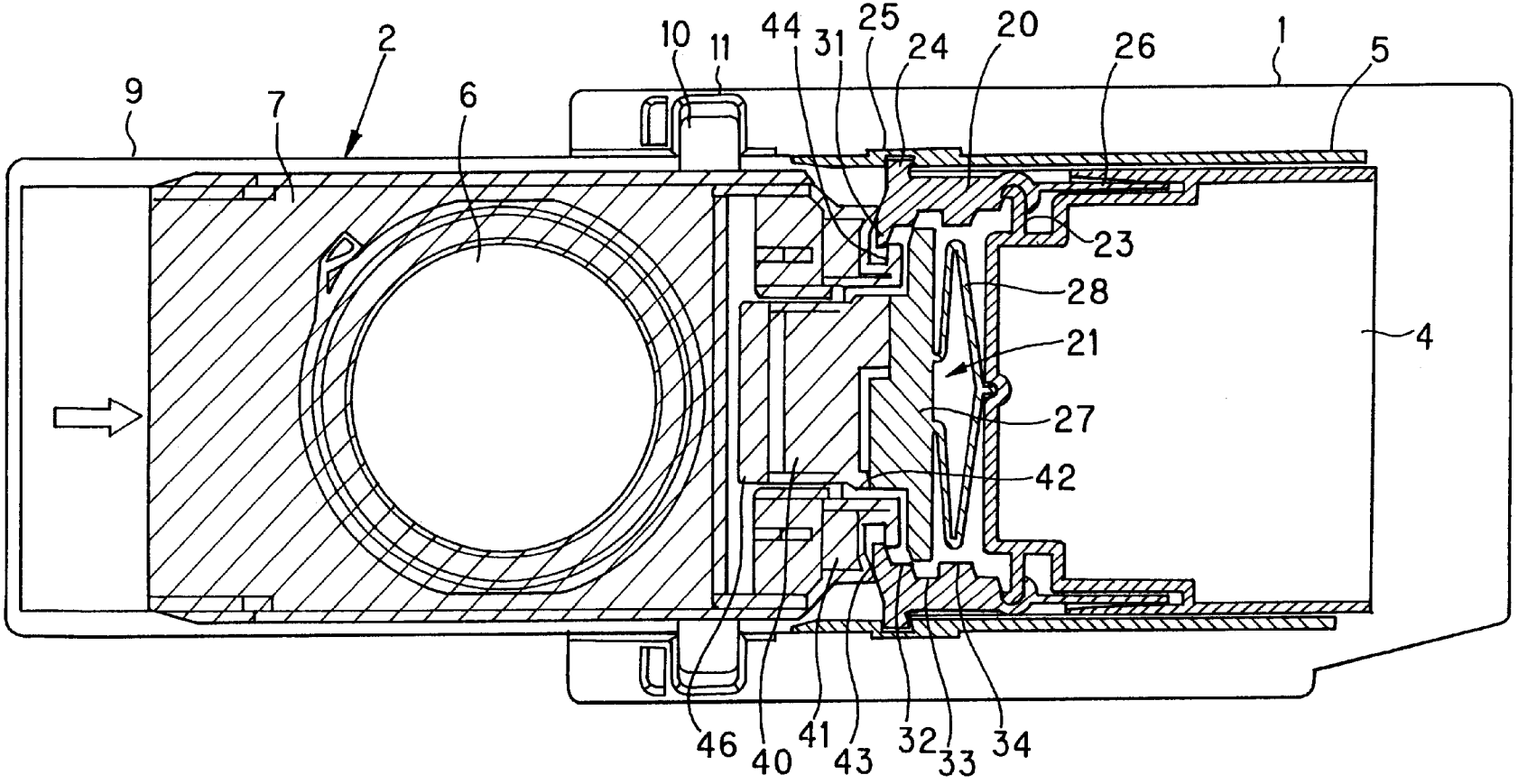
FIG. 20 is a plan view showing a toner supply system when a releasing element has thrust a fixing element.

When bottle slider 7 is further advanced from the state where releasing element 40 abuts against bearing portion 27, each engaging portion 44 moves and rides over hooking portion 31 while elastic portion 28 contracts as shown in FIG. 20. Thus, bearing portion 27 is thrust opposing the urging force of elastic portion 28. During this movement, bearing portion 27 moves from the position where it opposes abutment portions 32 of locking elements 20 to the position where it opposes spacing portions 33, to thereby release the restriction on locking elements 20 allowing their movement. At this point, however, each locking element 20 is urged outwards and sidewards by the urging force of leaf spring 26, hence engaging claw 24 remains engaged with cutout notch 25 of guide frame 5. Therefore, locking elements 20 are kept at their engaging positions, still prohibiting the movement of shutoff lid 4.

Figure 21:
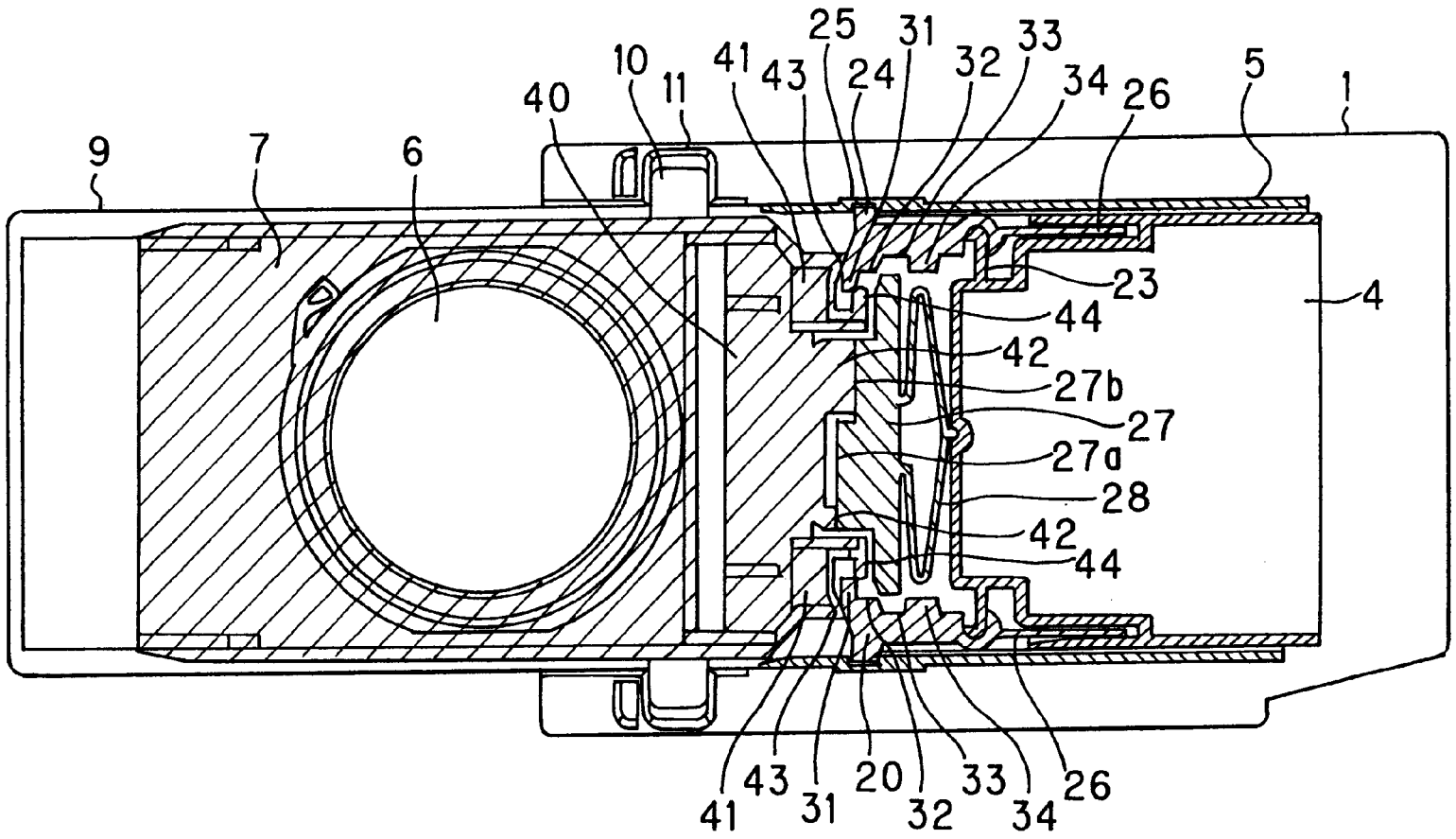
FIG. 21 is a plan view showing a toner supply system when a releasing element has thrust a fixing element.

When bottle slider 7 is further advanced from the state where projected abutment 42 abuts bearing portion 27, each engaging portion 44 moves and rides over hooking portion 31 while elastic portion 28 contracts as shown in FIG. 21. Thus, bearing portion 27 is thrust opposing the urging force of elastic portion 28. During this movement, bearing portion 27 moves from the position where it opposes abutment portions 32 of locking elements 20 to the position where it opposes spacing portions 33, to thereby release the restriction on locking elements 20 allowing their movement. At this point, however, each locking element 20 is urged outwards and sidewards by the urging force of leaf spring 26, hence engaging claw 24 remains engaged with cutout notch 25 of guide frame 5. Therefore, locking elements 20 are kept at their engaging positions, still prohibiting the movement of shutoff lid 4.

Figure 22:
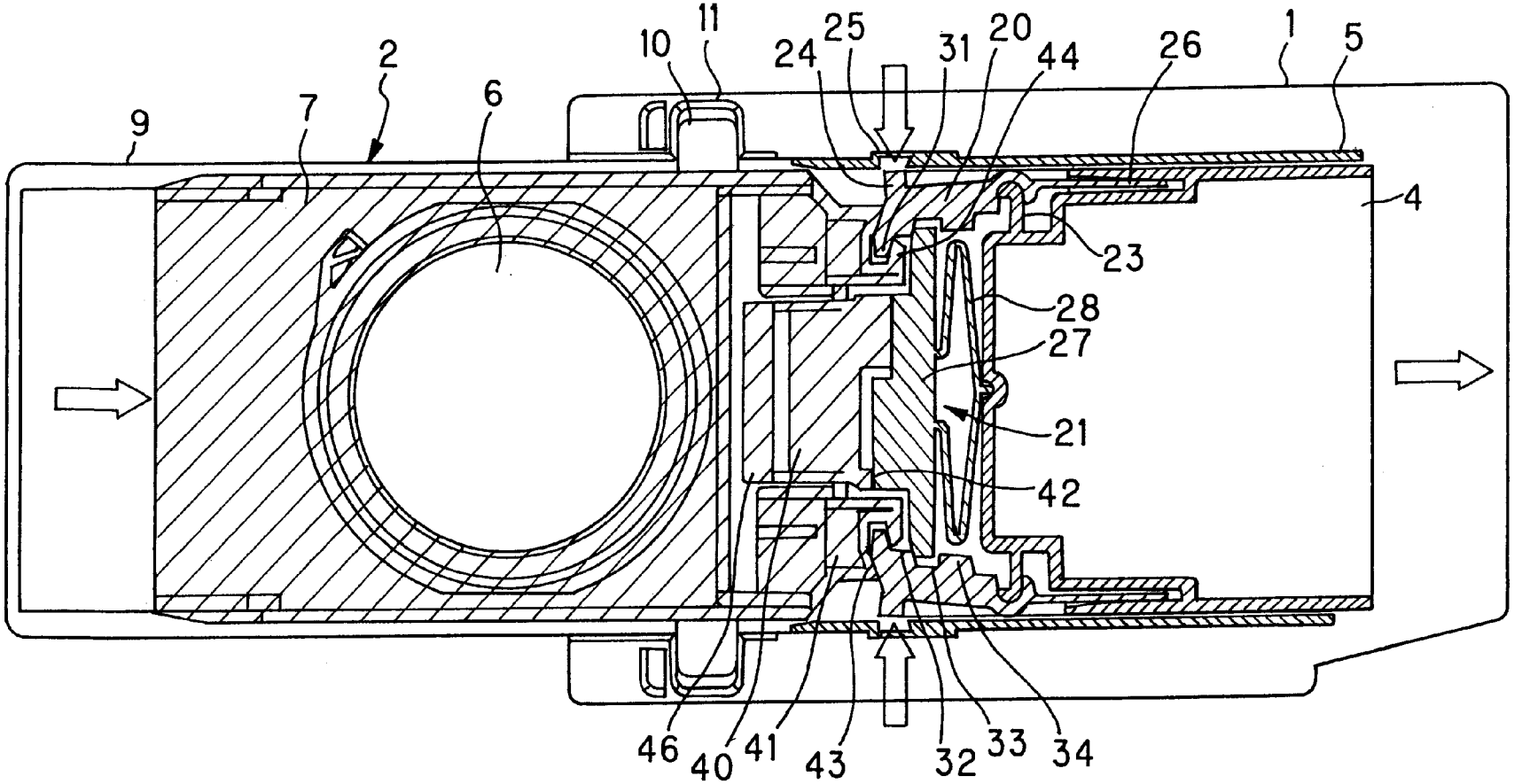
FIG. 22 is a plan view showing a toner supply system when the engagement of locking elements is released.
Figure 23:
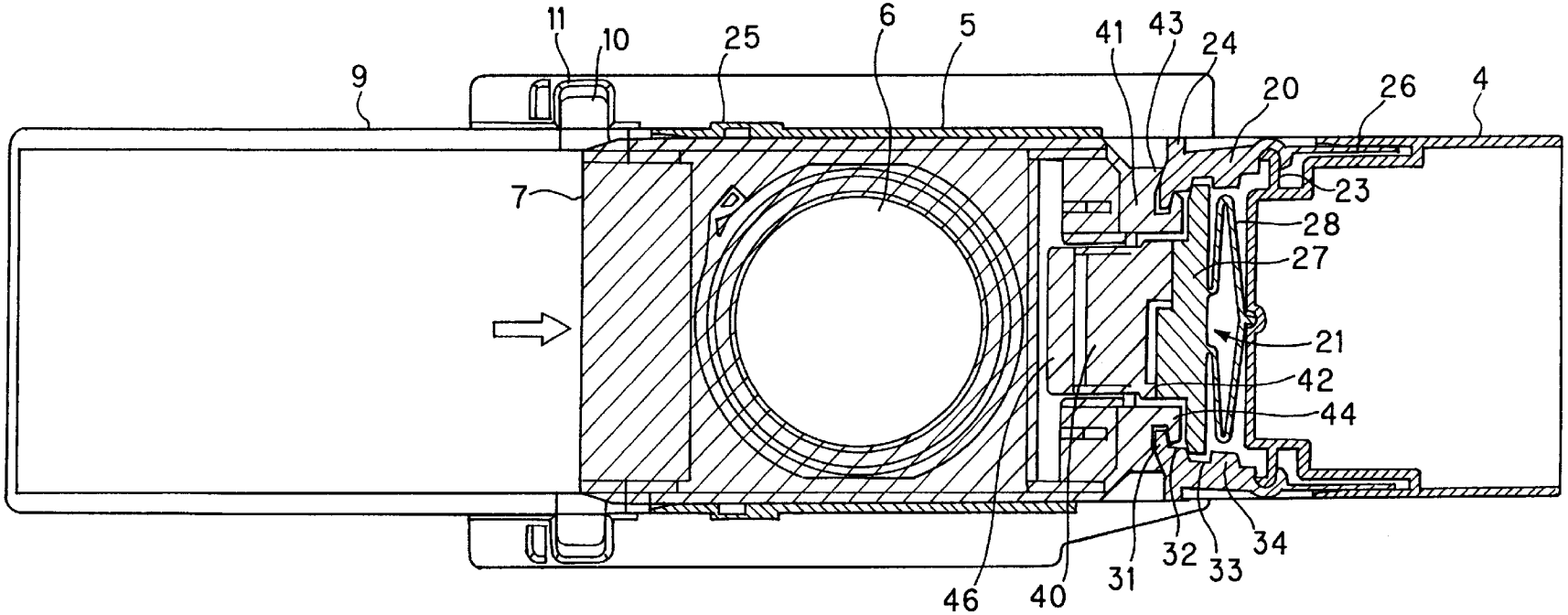
FIG. 23 is a plan view showing a toner supply system when a toner cartridge has reached the toner supply position.

A further advancement of bottle slider 7 causes each switching portion 43 of opening and closing element 41 to abut the rear face of locking element 20, so that locking element 20 moves inwards by the action of switching portion 43, as shown in FIG. 22. With this movement, engaging claw 24 leaves guide frame 5, thereby locking element 20 is set into the releasing state, or simply the locking state of locking element 20 is released. As bottle slider 7 is further advanced, shutoff lid 4 moves forward and shutoff lid 4 is opened, exposing the toner entrance port, as shown in FIG. 23. This completes setting of toner cartridge 2 to the toner supply position where the toner entrance port and opening 8 of toner bottle 6 are set aligned allowing communication.

In this way, since toner supply is allowed when toner cartridge 2 is completely set to the toner supply position, it is possible to reliably supply the toner at the toner supply position by removing the sealing element when the opening of toner cartridge 2 and the toner entrance port of toner hopper 1 perfectly communicate with each other.

Figure 24:
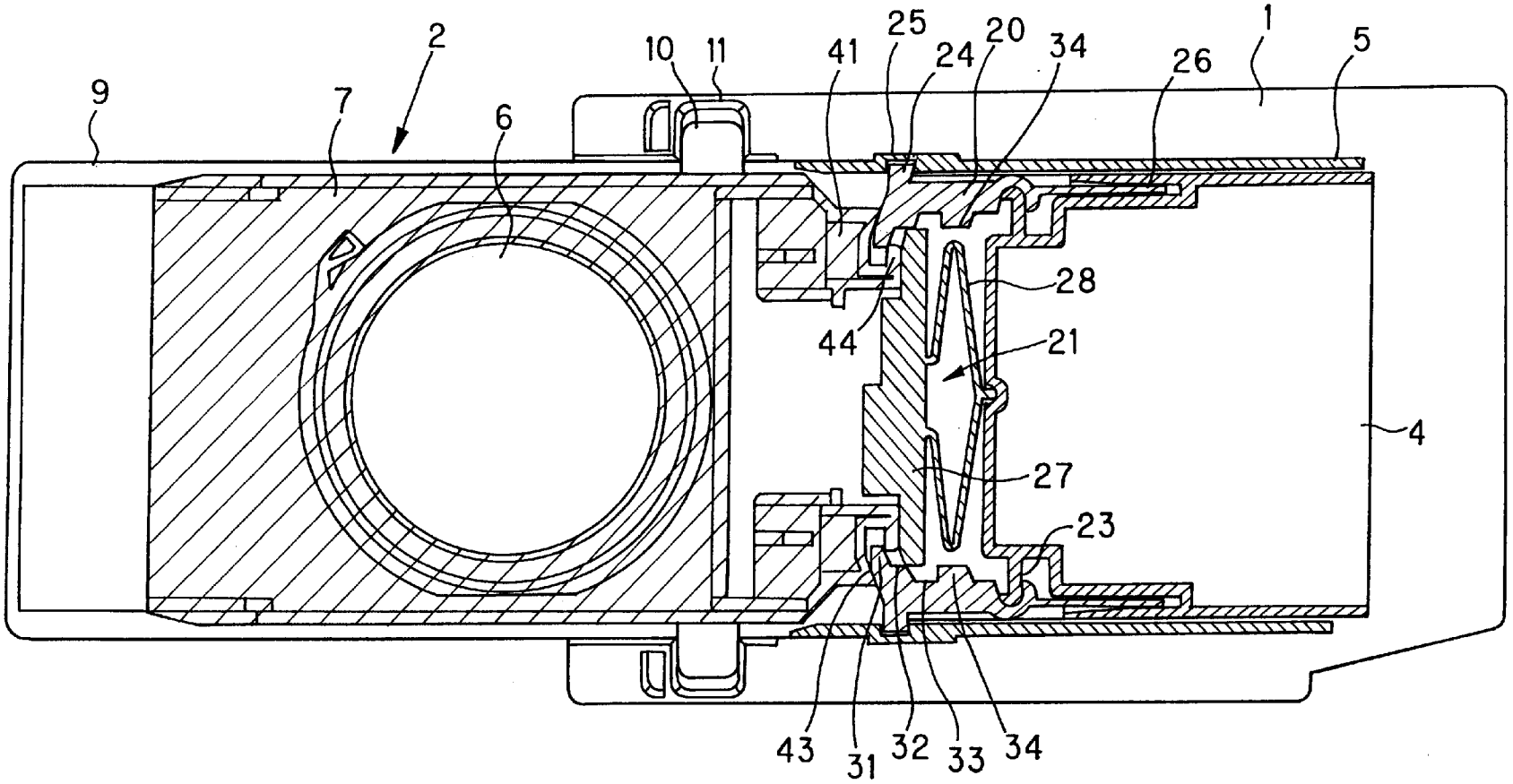
FIG. 24 is a plan view showing a toner supply system when a toner cartridge with a releasing element having an unsuitable stepped face is used.

It should be noted that the above operation is allowed only when the geometrical condition of the stepped face of fixing element 21 matches that of the stepped face of releasing element 40. So if the geometrical conditions do not match each other, shutoff lid 4 will not open. That is, when releasing element 40 lacks stepped portions or has a short projected portion, or when the cartridge has no releasing element 40 after the removal of sealing element 45 as shown in FIG. 24, releasing element 40 does not abut the stepped face of bearing portion 27 or it barely abuts but cannot thrust bearing portion 27 adequately. Therefore, bearing portion 27 will not move to the position where it opposes spacing portions 33 of locking elements 20 and remains abutted to abutment portions 32, so that locking elements 20 cannot move inwards, hence the locked state cannot be released.

Figure 25:
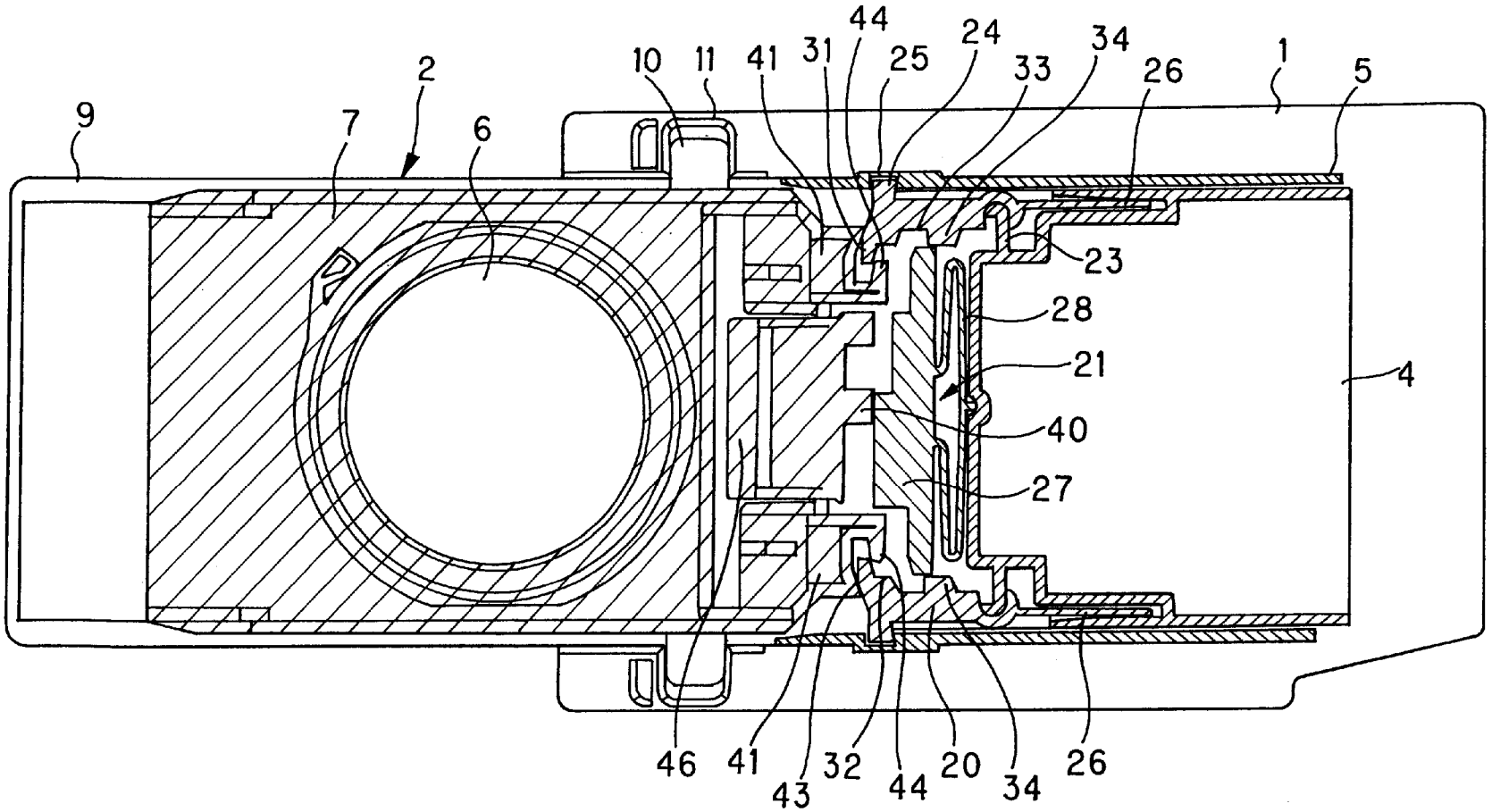
FIG. 25 is a plan view showing a toner supply system when a toner cartridge with a releasing element having an unsuitable stepped face is used.

Further, as shown in FIG. 25, when the projected portion of releasing element 40 is long, the thrust amount of bearing portion 27 is so large that bearing portion 27 reaches interference portions 34 passing over spacing portions 33 of locking elements 20. Therefore, the movement of locking elements 20 are constrained and hence the locking also cannot be released in this case. In this way, if locking elements 20 are unlocked, shutoff lid 4 is disallowed from opening, thus prohibiting the toner cartridge 2 from being attached to the toner supply position.

In the above toner cartridge 2, sealing element 45 covering toner supply opening 8 is attached integrally to releasing element 40 and can be peeled off from toner cartridge 2 by separating releasing element 40 from bottle slider 7. Because of this arrangement, if handle 46 is rotated carelessly while toner cartridge 2 is set to toner hopper 1 and advanced, releasing element 40 may be separated from bottle slider 7, disallowing release of shutoff lid 4. To avoid this, it is necessary to prohibit the rotation of releasing element 40 while toner cartridge 2 is being advanced and permit the rotation of releasing element 40 when toner cartridge 2 reaches the toner supply position. An anti-rotational element 150 is provided for shutoff lid 4.

As shown in FIGS. 26A to 26C and FIGS. 27A and 27B, anti-rotational element 150 is a flat plate which is arranged under fixing element 21 inside shutoff lid 4 with its one end connected to a compression spring 151 so that it can move within shutoff lid 4. Anti-rotational element 150 has a rectangular passage hole 152 as a hollow allowing rotation of releasing element 40 while toner hopper 1 has a rectangular hollow 153 on the top face thereof. Further, a cutout 154 is formed at the rear end of shutoff lid 4 correspondingly to passage hole 152. Anti-rotational element 150 moves as shutoff lid 4 moves but it is necessary to stop the movement of anti-rotational element 150 halfway. For this purpose, a stopper 155 is formed in toner hopper 1. When toner cartridge 2 has reached the toner supply position and opening 8 of toner cartridge 2 is perfectly set so as to communicate with toner entrance port 1*a*, passage hole 152 of anti-rotational element 150, cutout 154 and hollow 153 are aligned so as to create a space allowing releasing element 40 to rotate and descend therein. That is, stopper 155 is to position passage hole 152 of anti-rotational element 150 at hollow 153 of toner hopper 1.

Figures 26A, 26B, 26C:
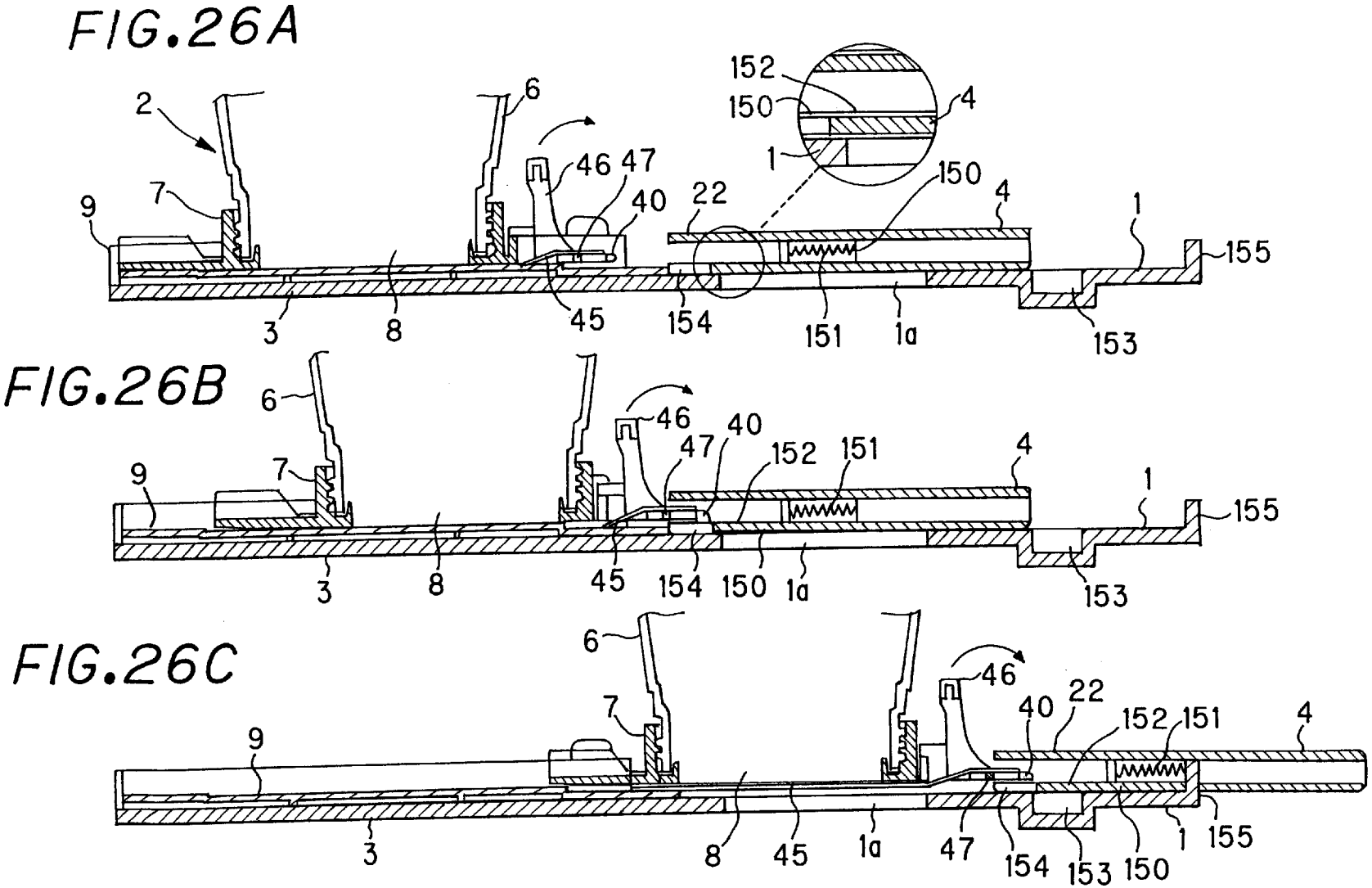
FIGS. 26A, 26B and 26C are illustrations for explaining how a releasing element is restricted from being rotated during the forward movement of a toner cartridge.

Now, description will made of how anti-rotational element 150 restricts the rotation of releasing element 40. First, as shown in FIG. 26A, when toner cartridge 2 is set to mount 3 of toner hopper 1, toner entrance port 1*a* formed on the top surface of toner hopper 1 is covered by shutoff lid 4. At this point, even if the operator, by mistake, tries to rotate handle 46 in the direction of the arrow in the figure so as to peel off sealing element 45 covering opening 8 of toner cartridge 2, the front end of releasing element 40 to which one end of sealing element 45 is fixed is restricted from rotating by the contact with the upper surface of cartridge cover 9, thus prohibiting separation of releasing element 40.

As shown in FIG. 26B, when toner cartridge 2 advances to a degree, bottle slider 7 separates from cartridge cover 9 while releasing element 40 abuts bearing portion 27 of fixing element 21 and reaches the upper position of anti-rotational element 150. Therefore, if handle 46 tries to be rotated, the front end of releasing element 40 comes into contact with anti-rotational element 150, whereby the rotation is restricted so as not to allow separation of releasing element 40 and removal of sealing element 45.

When toner cartridge 2 is further advanced, shutoff lid 4 moves as shown in FIG. 26C so that anti-rotational element 150 abuts stopper 155. At this point, shutoff lid 4 moves further but anti-rotational element 150 stops, and passage hole 152 of anti-rotational element 150 is positioned over hollow 153 of toner hopper 1. However, the rear end of shutoff lid 4 has yet to reach this point, so passage hole 152 and hollow 153 are not aligned with each other. The front end of releasing element 40 has not yet reached and moved over passage hole 152, therefore, the rotation of the releasing element is restricted by anti-rotational element 150.

Figure 27A:
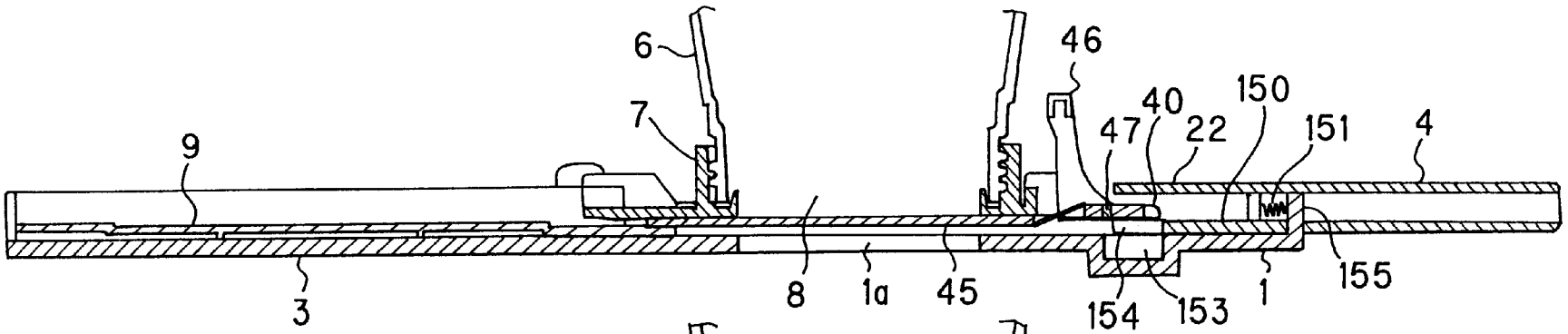
FIGS. 27A and 27B are illustrations for explaining peeling of a sealing element by rotation of a releasing element.
Figure 27B:
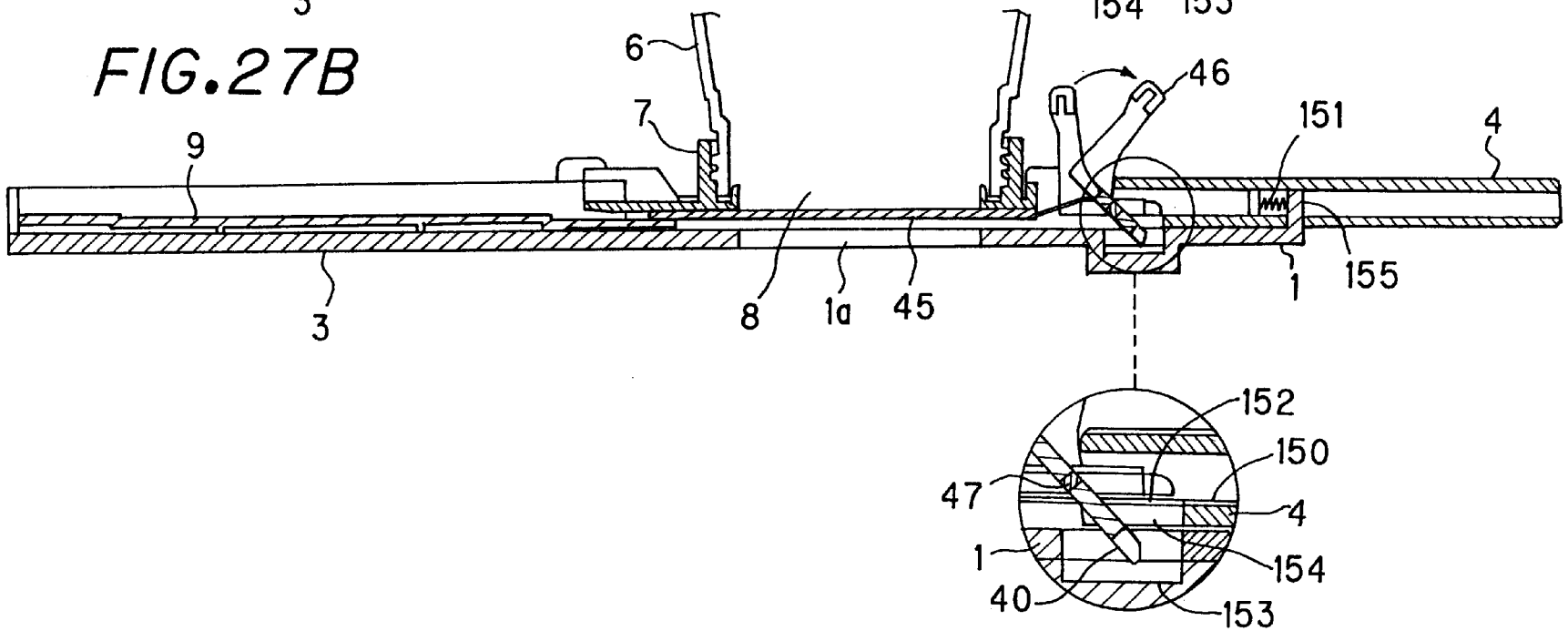

When toner cartridge 2 has reached the toner supply position, shutoff lid 4 opens toner entrance port 1*a* as shown in FIG. 27A, so that opening 8 of toner bottle 6 and toner entrance port 1*a* are set in perfect register with each other. At this point, cutout 154 at the rear end of shutoff lid 4, passage hole 152 and hollow 153 are aligned, so as to release the restriction by anti-rotational element 150, creating a space to which releasing element 50 plunges. From this state, as shown in FIG. 27B, when handle 46 is rotated in the direction of the arrow in the figure, releasing element 40 rotates about bridges 47 so that the front part of releasing element 40 plunges into the created space and bridges 47 breakoff. When releasing element 40 is thus separated from opening and closing elements 41, handle 46 is pulled out so as to peel sealing element 45 off bottle slider 7, whereby the toner can be supplied.

Since releasing element 40 is joined to opening and closing elements 41 not only by bridges 47 but also sub-bridges 48, it is difficult to separate releasing element 40 by mere rotation of handle 46, which will not produce a force strong enough to break bridges 47.

When handle 46 is pulled at the toner supply position, releasing element 40 starts rotating about bridges 47 as a fulcrum. As bridges 47 twist, contact portions 51 abut guide frame 5 and sub-bridges 48 break off first. Then, these contact portions 51 function as the fulcrum to produce a strong force acting on bridges 47 by leverage, thus breaking off the bridges. During this action, the rotation of releasing element 40 is interfered with so that it can be smoothly separated because of the presence of slack 45*a* in sealing element 45.

When releasing element 40 has been separated from opening and closing elements 41 in the above way, releasing element 40 is pulled up by holding handle 46. With this action, temporal tacking 45*b* of sealing element 45 is peeled off and sealing element 45 is pulled off from bottle slider 7.

As described heretofore, toner cartridge 2 and associated elements are configured so that releasing element 40 can be separated only when toner cartridge 2 is perfectly set at the toner supply position, it is only possible to pull off sealing element 45 in the state where opening 8 of toner cartridge 2 and toner entrance port 1*a* of toner hopper 1 are aligned so as to create perfect communication. Therefore, it is possible to make reliable toner supply at the toner supply position. When the toner cartridge 2 is attached out of place, sealing element 45 is not allowed to be removed. So, no toner will leak from toner cartridge 2, whereby it is possible to prevent contamination by toner on the top face of toner hopper 1, especially around toner entrance port 1*a*.

After toner cartridge 2 is set to toner hopper 1 and the toner is supplied, the toner cartridge 2 is returned again to mount 3 and is detached. In this procedure, the action of detaching toner cartridge 2 and the action of closing shutoff lid 4 are made so as to be linked. Actually, as shown in FIG. 23, since engaging portions 44 of opening and closing elements 41 have engaged with hooking portions 31 of locking elements 20 when shutoff lid 4 is open, shutoff lid 4 is drawn by locking elements 20 and shutoff lid 4 moves to the position where the toner entrance port is closed as bottle slider 7 is moved back to mount 3 after toner supply. During this movement, bearing portion 27 is urged rearwards by elastic portion 28 but movement of bearing portion 27 is constrained by its abutment against the wall faces of separating portions 33 of locking elements 20. Though releasing element 40 is illustrated in FIG. 23, releasing element 40 should be absent in this stage because it should have been removed together with sealing element 45 after toner supply.

Each locking element 20 in its releasing position is urged to the guide frame side by the action of leaf spring 26. Therefore, when shutoff lid 4 reaches the closed position of the toner entrance port, engaging claw 24 opposes cutout notch 25 of guide frame 5 and engaging claw 24 fits into cutout notch 25 as locking element 20 moves by the urging force. Thereby, locking element 20 becomes engaged with guide frame 5 and locked so that shutoff lid 4 is held in its closed state. At this point, engagement between engaging portion 44 and hooking portion 31 is released while bearing portion 27 also moves so as to oppose abutment portions 32.

A further backward movement of bottle slider 7 causes engaging portions 44 to ride over hooking portions 31, which positively set locking elements 20 in their engaging position. At this point, bearing portion 27, which has been restricted from moving by the presence of engaging portions 44, moves by the urging force from elastic portion 28 and abuts abutment portions 32, to thereby ensure the engaging position of locking elements 20. Bottle slider 7 is fitted to cartridge cover 9 located at mount 3, whereby toner cartridge 2 can be removed from toner hopper 1.

When bearing portion 27 of fixing element 21 moves as it is pressed by releasing elements 40, it moves along guide slot 30. During this movement, if a biased pressing force to one side with respect to the left and right direction acts on bearing portion 27, bearing portion 27 is turned or placed skew to one side about spindle 29 within the horizontal plane, prohibiting lock disengagement. For this reason, elastic portion 28 is formed of two leaf springs so as to make bearing portion 27 skew, to either right or left side.

Figure 28A:
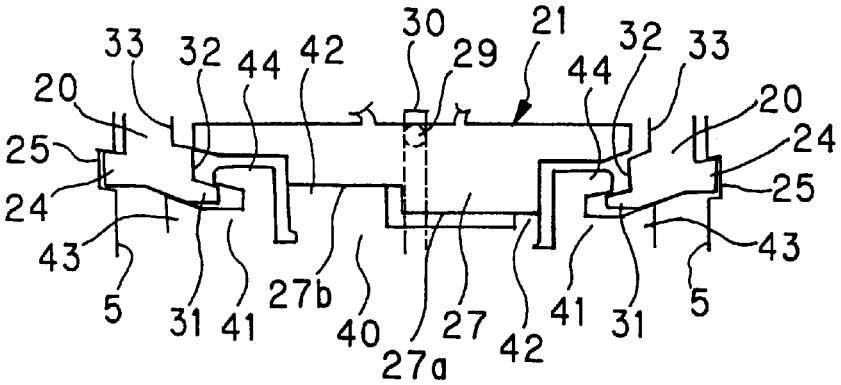
FIGS. 28A, 28B and 28C are illustrations for explaining how a fixing element moves depending upon the shape of releasing elements different in stepped face configuration.
Figure 28B:
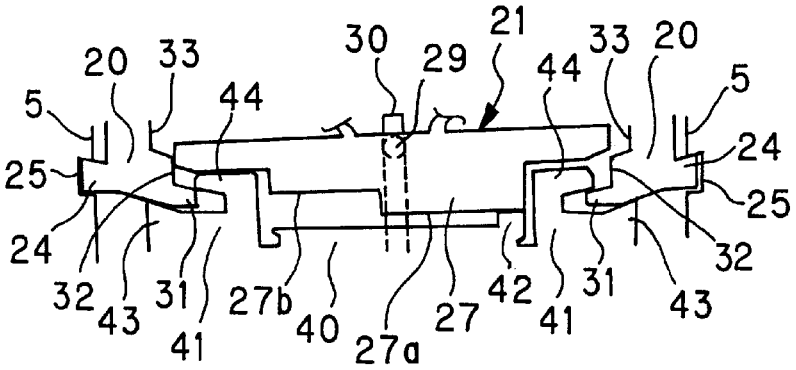

Illustratively, as shown in FIG. 28A, if the stepped face of bearing portion 27 exactly matches the stepped face of toner cartridge 2, equal forces with respect to the left and right direction act on bearing portion 27. Therefore, bearing portion 27 moves in parallel with respect to the left and right direction and releases the lock. On the other hand, if, as shown in FIG. 28B, the stepped face of bearing portion 27 matches the stepped face of releasing element 40, on only one side, either right or left, the urging force acts unequally on bearing portion 27 on only one side, either right or left. Therefore, bearing portion 27 moves obliquely. As a result, one side of bearing portion 27 leaves abutment portion 32 and faces spacing portion 33, releasing the associated locking element 20 while the other side of bearing portion 27 remains abutting abutment portion 32 and continues to restrict locking element 20, whereby the lock will not be released.

Figure 28C:
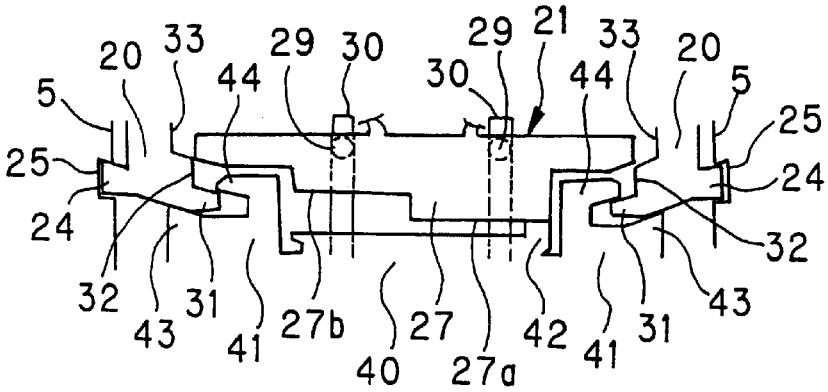

In cases where two or more guide slots 30 are formed, bearing portion 27 will not turn to one side within the horizontal plane as shown in FIG. 28C, so that the movement of bearing portion 27 is limited only to parallel shift. Therefore, even if the stepped face of bearing portion 27 matches the stepped face of releasing element 40, on only one side, either right or left, bearing portion 27 is bound to move in parallel, undesirably canceling the locked state. In conclusion, provision of only one guide slot 30 at the center with respect to the left and right direction permits bearing portion 27 to sway in the horizontal plane, thus making it possible to intentionally create an unstable supporting condition of bearing portion 27.

Accordingly, if the stepped face of bearing portion 27 does not exactly match the stepped face of releasing element 40, the forces acting on the left and right portions of bearing portion 27 are unbalanced, so that it is possible to reduce the risk of the locked state being released readily. This means that only simple combinations of projections and indentations can deal with a variety of toner brands and types.

Guide slot 30 also limits the movement (the amount of displacement) of bearing portion 27 by abutment of spindle 29 of bearing portion 27 against the front end of guide slot 30. If bearing portion 27 is thrust beyond the allowable distance, it passes over interference portions 34 of locking elements 20, and bearing portion 27 will no longer abut the inner faces of locking elements 20. Therefore, the locked state of the locking mechanism will be released. For this reason, the movement of bearing portion 27 should be limited to such a degree that the bearing portion will not pass over interference portions 34. Thus, bearing portion 27 will not be thrust beyond the allowable range, whereby it is possible to prevent the locked state of the locking mechanism from being released and it is possible to prevent locking elements 20 and fixing element 21 from being damaged by being overstressed.

Figure 29B:
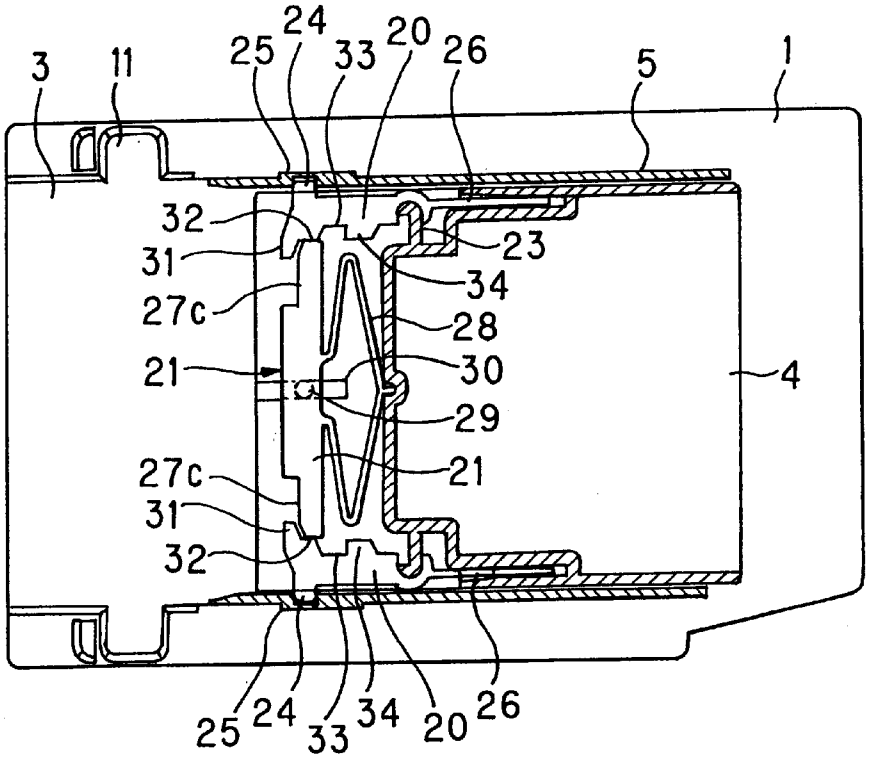
FIG. 29B is a plan view showing a locking mechanism of the same.
Figure 29A:
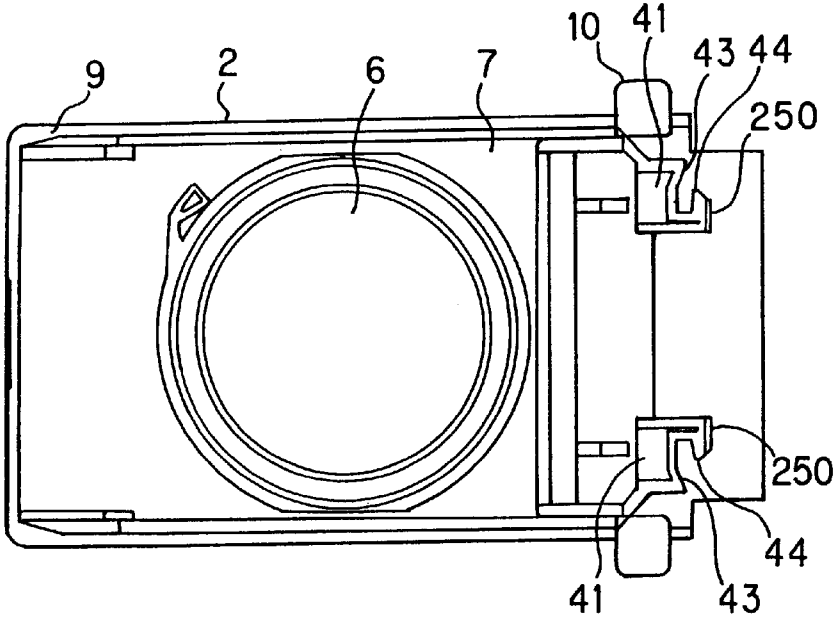
FIGS. 29A is a plan view showing an opening and closing mechanism in accordance with another embodiment.

In the above configuration, opening and closing elements 41 are formed separately from releasing element 40, but this is only because of their functions. However, these may be formed integrally. Actually, as another embodiment of toner cartridge 2, as shown in FIGS. 29A and 29B, opening and closing elements 41 are formed with a bottle slider 7 in the same manner as above while projected abutments 250 are formed with them. Projected abutment 250 is integrally formed with an engaging portion 44 and arranged in front of it. The rear side of a fixing portion 21 opposing projected abutments 250 is depressed at both left and right sides forming stepped faces or indented faces 27*c*. Each projected abutment 250 abuts corresponding indented face 27*c*. Other configurations are the same as above.

Figure 30:
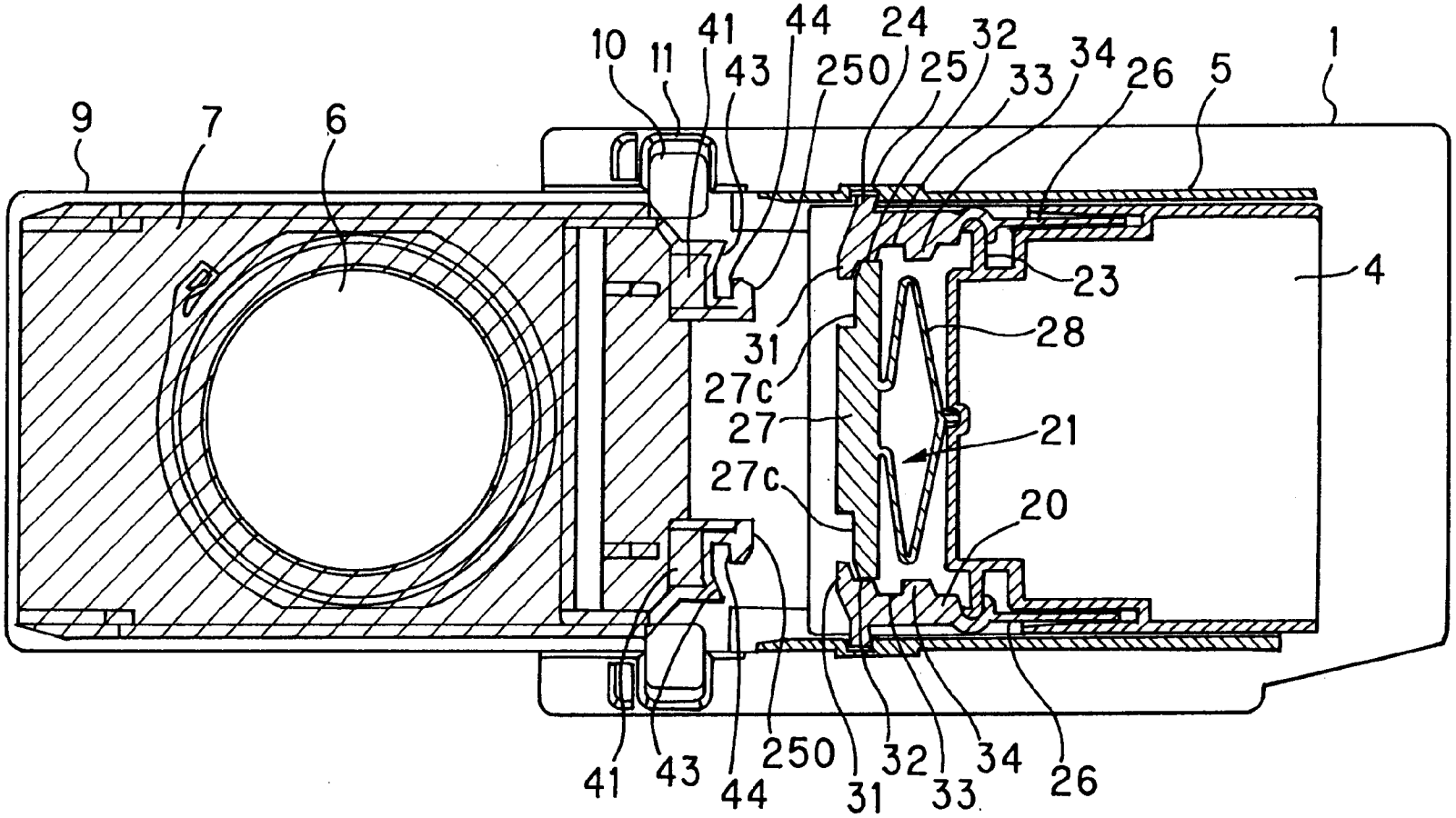
FIG. 30 is a plan view showing a toner supply system when a toner cartridge is placed on a toner hopper.

Next, the toner supply operation from toner cartridge 2 to toner hopper 1 thus configured will be described. Referring first to FIG. 30, toner cartridge 2 is placed on mount 3 on the top of toner hopper 1 so as to position cartridge cover 9. At this point, the distance between each indented face 27*c* of bearing portion 27 and left and right projected abutment 250 is shorter than the distance between the rear face of locking element 20 and switching portion 43 of opening and closing element 41.

Then, as bottle slider 7 is made to advance as it is abutted on the top surface of toner hopper 1, bottle slider 7 moves along cartridge cover 9 and the front side of releasing element 40 becomes inserted into cover 22 of shutoff lid 4. A further advancement causes each projected abutment 250 to abut hooking portion 31 of locking element 20. At this point, hooking portions 31 are pushed by projected abutments 250 and flex outwards and sidewards while projected abutments 250 themselves also flex, so that projected abutments 250 ride over hooking portions 31 and abut indented faces 27*c* of bearing portion 27 before switching portions 43 abut locking elements 20.

Figure 31:
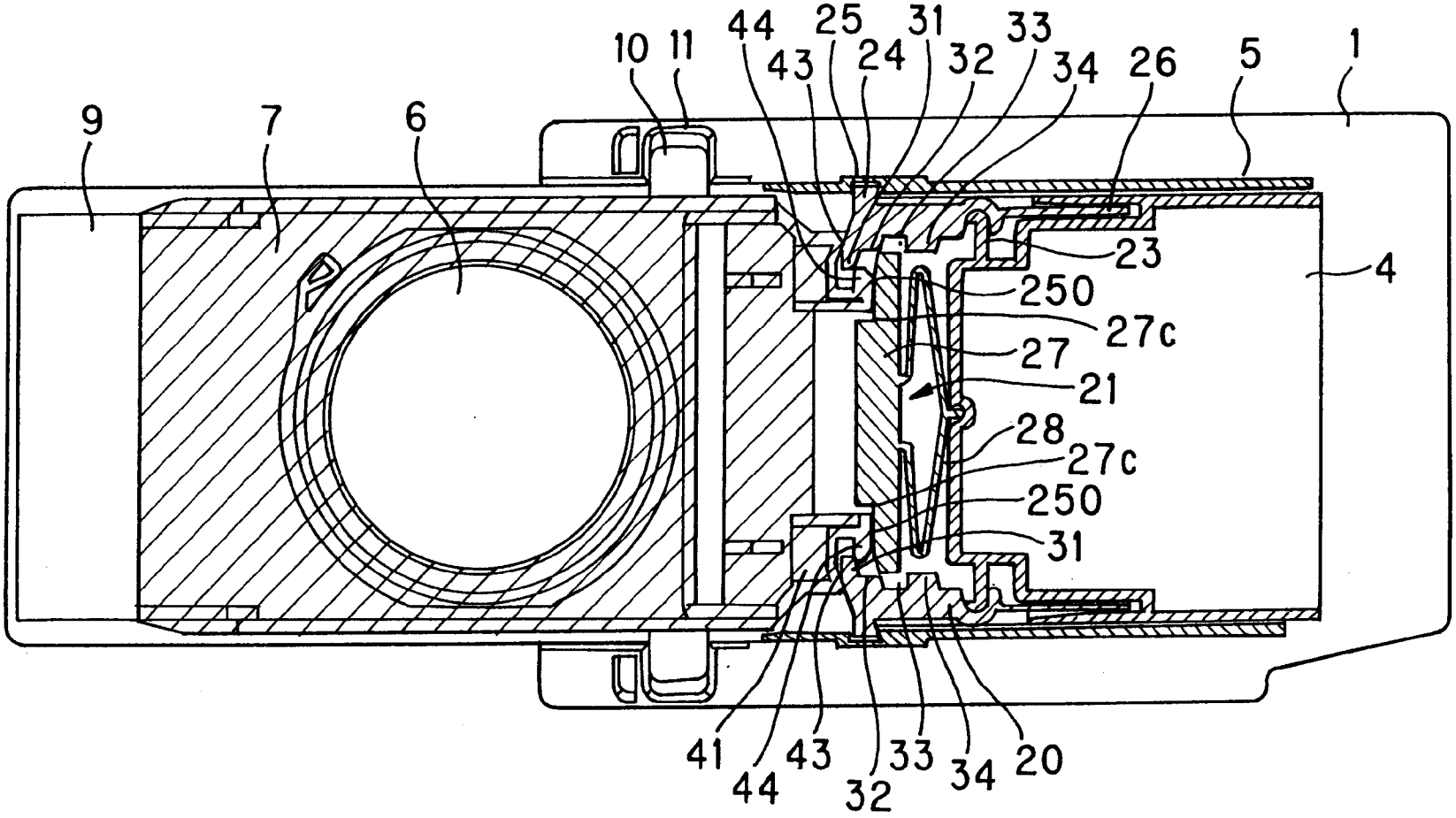
FIG. 31 is a plan view showing a toner supply system when a releasing element has thrust a fixing element.

As shown in FIG. 31, the stepped face of bottle slider 7 and the stepped face of bearing portion 27 abut and mesh each other, and elastic portion 28 contracts. Thus, bearing portion 27 is inserted opposing the urging force of elastic portion 28. During this movement, bearing portion 27 moves from the position where it opposes abutment portions 32 of locking elements 20 to the position where it opposes spacing portions 33, to thereby release its restriction on locking elements 20 allowing their movement. At this point, however, each locking element 20 is urged outwards and sidewards by the urging force of leaf spring 26, hence engaging claw 24 remains engaged with cutout notch 25 of guide frame 5. Therefore, locking elements 20 are kept in their engaging positions, still prohibiting the movement of shutoff lid 4.

Figure 32:
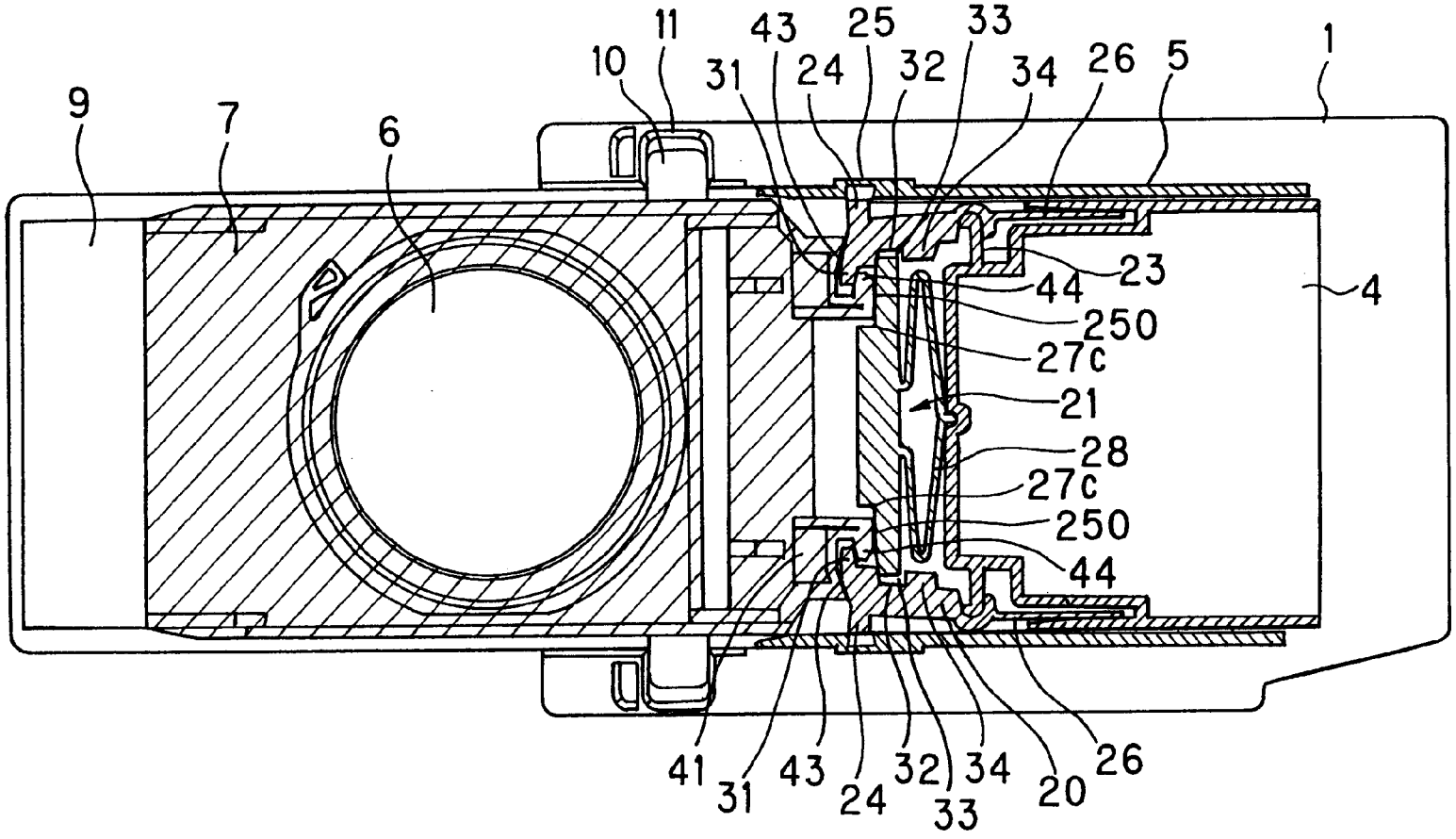
FIG. 32 is a plan view showing a toner supply system when the engagement of locking elements is released.
Figure 33:
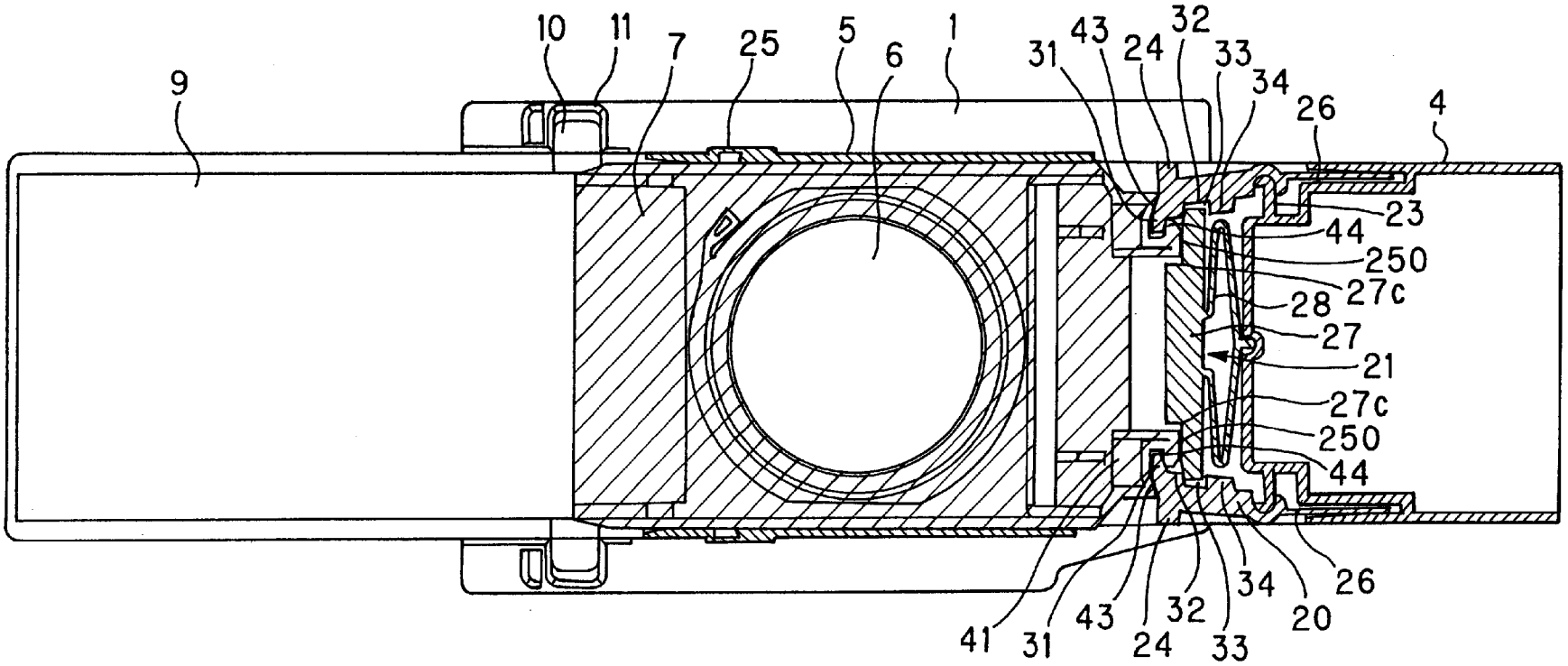
FIG. 33 is a plan view showing a toner supply system when a toner cartridge has reached the toner supply position.

A further advancement of bottle slider 7 causes each switching portion 43 of opening and closing element 41 to abut the rear face of locking element 20, so that locking element 20 moves inwards by the action of switching portion 43, as shown in FIG. 32. With this movement, engaging claw 24 leaves guide frame 5, thereby locking element 20 is set into the releasing position, or simply the locking state of locking element 20 is undone. As bottle slider 7 is further advanced, shutoff lid 4 moves forward and shutoff lid 4 is opened, as shown in FIG. 33. This completes setting of toner cartridge 2 to the toner supply position where the toner can be supplied.

It is noted the present invention should not be limited to the above embodiments and many changes and modifications can be added to the above embodiments within the scope of the present invention. For example, the projected and indented faces of the releasing element and fixing element are not limited to rectangular configurations as in the above embodiments, but waved, comb-like and curved faces may be used as long as the dimensions of the projections and other shapes are specified so as to actuate the associated elements in the predetermined order. The opening and closing elements are formed separately from the releasing element, but this is only because of their functions. Therefore, these may be formed integrally. Also in this case, this integrated element should be designed so that part of it will be separated and the sealing element will be attached thereto.

In the above embodiments, the locking elements are adapted to move in the left and right direction so as to engage the side faces of the guide frame. However, it is possible to provide a locking element which moves up and down so as to engage the upper face of the guide frame or the top surface of the toner hopper.

As has been described above, according to the present invention, the shutoff lid cannot be opened unless the feature of the front face of projected abutments and switching portions etc. in the cartridge exactly matches the feature of the rear face of the shutoff lid, the lock to the shutoff lid can be opened only when a toner cartridge suited to the machine is set. Therefore, it is possible to prevent erroneous charging of toners for other machines or toners of different colors by a modified, inappropriate toner cartridge. Further, it is possible to prevent the shutoff lid of the toner hopper from being opened by force manually or using a tool etc., hence it is possible to avoid unwanted troubles occurring with diverted use of a toner for other machines and contamination of dust, dirt and other foreign matter. Thus, it is possible to prevent release of the lock by a simple work such as cutting part of the toner cartridge as well as to provide a toner cartridge configuration which cannot be modified easily, thus enhancing reliability of the locking mechanism.

In addition, only when the toner cartridge is set in a correct manner, the associated components are linked to cause the shutoff lid to move in the opening direction, whereby the toner supply opening of the toner cartridge and the toner entrance port of the toner hopper are aligned to provide perfect communication. Thus this configuration makes it possible to prevent contamination by toner around the toner entrance port and enables reliable toner supplying work.

Since the sealing element covering the toner supply opening of the toner cartridge is fixed to the releasing element, separation of this releasing element makes release of the lock to the shutoff lid impossible and hence prohibits toner supply. Accordingly, the toner which has lowered in quality and performance due to being unsealed can be prevented from being charged into the hopper and hence occurrences of degradation of the image quality and development troubles can be prevented. Further, since the shutoff lid will not open if a waste toner cartridge is mounted, unnecessary work can be refrained. For this purpose, the releasing element is joined to the cartridge body by means of the bridges and sub-bridges so as to prevent the releasing element from being accidentally separated from the unused toner cartridge.

In order to peel this sealing element together with the releasing element, projections which allow balanced contact with the shutoff lid, restraining ribs for positioning the releasing element and contact portions in contact with the guide frame are provided. Thereby, it is possible to make smooth movement of the releasing element with improved operativity when it is rotated for separation. Further, since the sealing element is attached loosely with a slack to the releasing element, the releasing element can be smoothly separated without being affected by the sealing element.

By giving variety to the front faces of toner cartridges, it is possible to readily deal with many types of toner cartridges, thus allowing correct use of the suitable toner cartridge. In this case, only simple combinations of projections and indentations instead of a complicated shape makes it possible to produce many variations dealing with a variety of toner brands and types.

The projected abutments are arranged at retracted positions with respect to the front edge of the toner cartridge. This configuration protects the projected abutments from being deformed or damaged even if the toner cartridge is handled roughly. Accordingly, it is possible to prevent malfunctions of the locking mechanism due to such deformation or the like.

Since a multiple number of projected abutments, at least two on the left and right, are formed on the front side of the toner cartridge body, it is possible to positively move the fixing element, which assures reliable release of the lock. Accordingly, if the feature and geometrical arrangement of the projected abutments differ from the counter part of the fixing element, it is impossible to move the fixing element. Thus, this configuration prevents an inappropriate toner cartridge from being set and prevents the lock from being released by a modified toner cartridge, leading to increased reliability of the locking mechanism.

What is claimed is:

1. A toner supply system for supplying a toner hopper with the toner from a toner cartridge via a toner entrance port formed on the toner hopper, the toner hopper including:

a shutoff lid disposed movably along a top surface thereof for opening and closing the toner entrance port;

a guide frame disposed along the walls def ining the toner entrance port for guiding the shutof f lid in the opening and closing directions thereof;

a locking element for keeping the shutoff lid in the closed state; and a fixing element fixing the locking element and having a stepped face on one side thereof, the toner cartridge including:

a releasing element which has a stepped face mating the stepped face of the fixing element and moves the fixing element so as to allow the locking element to move as the toner cartridge moves forwards; and an opening and closing element which moves the locking element so as to move the shutoff lid, characterized in that when the toner cartridge is mounted on the mount of the toner hopper, the releasing element and the fixing element are placed opposing each other with their stepped faces opposed to each other and the two stepped faces mesh with each other as the toner cartridge moves forwards, whereby the fixing element is allowed to move and the shutoff lid can be opened.

2. A toner supply system for supplying a toner hopper with the toner from a toner cartridge via a toner entrance port formed on the toner hopper, the toner hopper including:

a shutoff lid disposed movably along a top surface thereof for opening and closing the toner entrance port;

a guide frame disposed along the walls defining the toner entrance port for guiding the shutoff lid in the opening and closing directions thereof;

a locking element for keeping the shutoff lid in the closed state; and a fixing element fixing the locking element and having a stepped face on one side thereof, the toner cartridge including:

a releasing element which has a stepped face mating the stepped face of the fixing element and moves the fixing element so as to allow the locking element to move as the toner cartridge moves forwards; and an opening and closing element which moves the locking element so as to move the shutoff lid, wherein when the toner cartridge is mounted on the mount of the toner hopper, the releasing element and the fixing element are placed opposing each other with their stepped faces opposed to each other and the two stepped faces mesh with each other as the toner cartridge moves forwards, whereby the fixing element is allowed to move and the shutoff lid can be opened, and in that the shutoff lid has a guide portion that loosely holds the fixing element and guides the fixing element in the opening and closing directions while the guide portion constrains the moving range of the fixing element when the toner cartridge moves forwards.

3. The toner supply system according to claim 2, wherein the fixing element has a spindle formed thereon while the guide portion is formed of a guide slot extending in parallel to the opening and closing direction and loosely holds the spindle so that the fixing element can sway about the spindle, and only when the fixing element makes parallel movement without swaying, the fixing element permits the locking element to switch from the engaging position where the locking element engages the guide frame to the releasing position where the locking element is disengaged from the guide frame.

4. A toner supply system for supplying a toner hopper with the toner from a toner cartridge via a toner entrance port formed on the toner hopper, the toner hopper including:

a shutoff lid disposed movably along a top surface thereof for opening and closing the toner entrance port;

a guide frame disposed along the walls defining the toner entrance port for guiding the shutoff lid in the opening and closing directions thereof;

a locking element for keeping the shutoff lid in the closed state; and a fixing element fixing the locking element and having a stepped face on one side thereof, the toner cartridge including:

a releasing element which has a stepped face mating the stepped face of the fixing element and moves the fixing element so as to allow the locking element to move as the toner cartridge moves forwards; and an opening and closing element which causes the locking element to move so as to release the engagement between the locking element and the guide frame and move the shutoff lid, characterized in that when the toner cartridge is mounted on the mount of the toner hopper, the releasing element and the fixing element are placed opposing each other with their stepped faces opposed to each other and the two stepped faces mesh with each other as the toner cartridge moves forwards, whereby the fixing element is allowed to move and the shutoff lid can be opened, and in that the opening and closing element has an engaging portion which engages the locking element having been disengaged from the guide frame and being in the releasing position and the engaging portion engages the locking element so as to move the shutoff lid as the toner cartridge moves rearwards.

5. The toner supply system according to claim 4, wherein the locking element has a hooking portion that engages the engaging portion of the opening and closing element when the locking element is in the releasing position and the outer end face of the engaging portion is formed closer to the guide frame than the inner end face of the hooking portion so that the engaging portion urges the locking element towards the guide frame as the toner cartridge moves rearwards.

6. A toner supply system for supplying a toner hopper with the toner from a toner cartridge via a toner entrance port formed on the toner hopper, the toner hopper including:

a shutoff lid disposed movably along a top surface thereof for opening and closing the toner entrance port;

a guide frame disposed along the walls defining the toner entrance port for guiding the shutoff lid in the opening and closing directions thereof;

a locking element for keeping the shutoff lid in the closed state; and a fixing element fixing the locking element and having a stepped face on one side thereof, the toner cartridge including:

a releasing element which has a stepped face mating the stepped face of the fixing element and moves the fixing element so as to allow the locking element to move as the toner cartridge moves forwards; and an opening and closing element which moves the locking element so as to move the shutoff lid, characterized in that when the toner cartridge is mounted on the mount of the toner hopper, the releasing element and the fixing element are placed opposing each other with their stepped faces opposed to each other and the two stepped faces mesh with each other as the toner cartridge moves forwards, whereby the fixing element is allowed to move and the shutoff lid can be opened, and in that the toner cartridge further comprises a sealing element covering the toner supply opening thereof, the sealing element is attached to an attachment structure which is constructed by either the opening and closing element or releasing element, and the attachment structure is integrally formed with the toner cartridge in a separable manner so that the sealing element is peeled from the toner cartridge by separating the attachment structure from the toner cartridge.

7. The toner supply system according to claim 6, wherein the attachment structure is supported rotatably by the toner cartridge, the shutoff lid has an anti-rotational element that is put in contact with the attachment structure so as to limit the rotation of the attachment structure, the anti-rotational element has a hollow allowing rotation of the attachment structure, and when the toner cartridge has moved to a position where the shutoff lid is opened and the opening of the toner cartridge is aligned with the toner entrance port so as to create communication therebetween, a handle reaches the hollow and becomes allowed to rotate and be removed from the toner cartridge.

8. The toner supply system according to claim 1, wherein the opening and closing element is formed with a switching portion which abuts the locking element and causes the locking element to switch from the engaging position where the locking element engages the guide frame to the releasing position where the locking element is disengaged from the guide frame, and the distance between the stepped face of the fixing element and the stepped face of the releasing element is shorter than the distance between the locking element and the switching portion when the toner cartridge is placed on the mount.

9. The toner supply system according to claim 2, wherein the opening and closing element is formed with a switching portion which abuts the locking element and causes the locking element to switch from the engaging position where the locking element engages the guide frame to the releasing position where the locking element is disengaged from the guide frame, and the distance between the stepped face of the fixing element and the stepped face of the releasing element is shorter than the distance between the locking element and the switching portion when the toner cartridge is placed on the mount.

10. The toner supply system according to claim 4, wherein the opening and closing element is formed with a switching portion which abuts the locking element and causes the locking element to switch from the engaging position where the locking element engages the guide frame to the releasing position where the locking element is disengaged from the guide frame, and the distance between the stepped face of the fixing element and the stepped face of the releasing element is shorter than the distance between the locking element and the switching portion when the toner cartridge is placed on the mount.

11. The toner supply system according to claim 6, wherein the opening and closing element is formed with a switching portion which abuts the locking element and causes the locking element to switch from the engaging position where the locking element engages the guide frame to the releasing position where the locking element is disengaged from the guide frame, and the distance between the stepped face of the fixing element and the stepped face of the releasing element is shorter than the distance between the locking element and the switching portion when the toner cartridge is placed on the mount.

12. The toner supply system according to claim 8, wherein the fixing element is formed with a bearing portion that abuts the locking element and keeps the locking element in the engaging position while the locking element is formed with a constraint avoidance portion which allows avoidance of the constraint by the bearing portion when the locking element is set into the releasing position, and the distance between the bearing portion and the constraint avoidance portion is specified to be shorter than the distance between the switching portion and the locking element in the state where the stepped face of the fixing element meshes the stepped face of the releasing element.

13. The toner supply system according to claim 9, wherein the fixing element is formed with a bearing portion that abuts the locking element and keeps the locking element in the engaging position while the locking element is formed with a constraint avoidance portion which allows avoidance of the constraint by the bearing portion when the locking element is set into the releasing position, and the distance between the bearing portion and the constraint avoidance portion is specified to be shorter than the distance between the switching portion and the locking element when the stepped face of the fixing element meshes the stepped face of the releasing element.

14. The toner supply system according to claim 10, wherein the fixing element is formed with a bearing portion that abuts the locking element and keeps the locking element in the engaging position while the locking element is formed with a constraint avoidance portion which allows avoidance of the constraint by the bearing portion when the locking element is set into the releasing position, and the distance between the bearing portion and the constraint avoidance portion is specified to be shorter than the distance between the switching portion and the locking element when the stepped face of the fixing element meshes the stepped face of the releasing element.

15. The toner supply system according to claim 11, wherein the fixing element is formed with a bearing portion that abuts the locking element and keeps the locking element in the engaging position while the locking element is formed with a constraint avoidance portion which allows avoidance of the constraint by the bearing portion when the locking element is set into the releasing position, and the distance between the bearing portion and the constraint avoidance portion is specified to be shorter than the distance between the switching portion and the locking element when the stepped face of the fixing element meshes the stepped face of the releasing element.

16. The toner supply system according to claim 12, wherein the fixing element has an elastic portion for elastically and movably supporting the bearing portion, and the movement of the bearing portion switches the position of the locking element into the releasing position.

17. The toner supply system according to claim 13, wherein the fixing element has an elastic portion for elastically and movably supporting the bearing portion, and the movement of the bearing portion switches the position of the locking element into the releasing position.

18. The toner supply system according to claim 14, wherein the fixing element has an elastic portion for elastically and movably supporting the bearing portion, and the movement of the bearing portion switches the position of the locking element into the releasing position.

19. The toner supply system according to claim 15, wherein the fixing element has an elastic portion for elastically and movably supporting the bearing portion, and the movement of the bearing portion switches the position of the locking element into the releasing position.

20. A toner supply system for supplying a toner hopper with the toner from a toner cartridge via a toner entrance port formed on the toner hopper, the toner hopper including:

a shutoff lid disposed movably along a top surface thereof for opening and closing the toner entrance port;

a guide frame disposed along the walls defining the toner entrance port for guiding the shutoff lid in the opening and closing directions thereof;

a locking element for keeping the shutoff lid in the closed state; and a fixing element fixing the locking element and having a stepped face on one side thereof, the toner cartridge including:

a releasing element which has a stepped face mating the stepped face of the fixing element and moves the fixing element so as to allow the locking element to move as the toner cartridge moves forward; and an opening and closing element which moves the locking element so as to move the shutoff lid, wherein one end of a sealing element for covering the toner supply opening of the toner cartridge body is attached to the releasing element and the releasing element is configured so as to be separable from the toner cartridge body, and in that the faces of the fixing element and releasing element which oppose when the toner cartridge is set on the toner hopper are formed with stepped faces mating with each other and a stiffening rib is formed in the toner cartridge body while the shutoff lid has a guide which permits the stiffening rib to fit therein.

21. A toner cartridge for supplying a toner to atoner hopper which has a shutoff lid for opening and closing a toner entrance port thereof, a locking element for keeping the shutoff lid in the closed state and a fixing element for fixing the locking element, via the toner entrance port by opening the shutoff lid, comprising:

a releasing element which moves the fixing element so as to allow the locking element to move; and and opening and closing element which moves the shutoff lid while moving the locking element, wherein the releasing element is formed with a stepped face so as to mate with the stepped face formed on the fixing element, and when the two stepped faces mesh with each other, the fixing element is moved so as to allow the shutoff lid to open.

22. The toner cartridge according to claim 21, further comprising: a sealing element covering the toner supply opening, wherein the sealing element is integrally joined to the opening and closing element or the releasing element so that the sealing element is peeled off by separating the opening and closing element or the releasing element from the toner cartridge.

23. A toner cartridge for supplying a toner to a toner hopper which has a shutoff lid for opening and closing a toner entrance port thereof, a guide frame disposed along the walls defining the toner entrance port for guiding the shutoff lid in the opening and closing direction thereof, a locking element for keeping the shutoff lid in the closed state and a fixing element fixing the locking element, via the toner entrance port by opening the shutoff lid in the toner supply position, comprising:

a releasing element which moves the fixing element so as to release the locked state by the locking element, the releasing element being separably attached to the toner cartridge body; and a sealing element covering the toner supply opening of the toner cartridge body, wherein one end of the sealing element is attached to the releasing element.

24. The toner cartridge according to claim 23, wherein a slack is formed on one side of the sealing element.

25. The toner cartridge according to claim 24, wherein the slack of the sealing element is temporarily tacked to the toner cartridge body or the releasing element.

26. A toner cartridge for supplying a toner to a toner hopper which has a shutoff lid for opening and closing a toner entrance port thereof, a guide frame disposed along the walls defining the toner entrance port for guiding the shutoff lid in the opening and closing direction thereof, a locking element for keeping the shutoff lid in the closed state and a fixing element fixing the locking element, via the toner entrance port by opening the shutoff lid in the toner supply position, comprising:

a releasing element which moves the fixing element so as to release the locked state by the locking element, the releasing element being formed with the toner cartridge body in such a manner as to be separable from the toner cartridge body by bridges, the releasing element being adapted to be rotatable about the same axis as that of the bridges; and a sealing element covering the toner supply opening of the toner cartridge body, with one end thereof attached to the releasing element, wherein the releasing element is formed with a projection which avoids contact between the front end of the releasing element and the shutoff lid and comes into uniform contact with the shutoff lid when the releasing element is rotated for separation.

27. A toner cartridge for supplying a toner to a toner hopper which has a shutoff lid for opening and closing a toner entrance port thereof, a guide frame disposed along the walls defining the toner entrance port for guiding the shutoff lid in the opening and closing direction thereof, a locking element for keeping the shutoff lid in the closed state and a fixing element fixing the locking element, via the toner entrance port by opening the shutoff lid in the toner supply position, comprising:

a releasing element which moves the fixing element so as to release the locked state by the locking element, the releasing element being formed with the toner cartridge body in such a manner as to be separable from the toner cartridge body by bridges, the releasing element being adapted to be rotatable about the same axis as that of the bridges; and a sealing element covering the toner supply opening of the toner cartridge body, with one end thereof attached to the releasing element, wherein a restraining rib for positioning the releasing element in the toner supply position is provided.

28. The toner cartridge according to claim 27, wherein the restraining rib is formed in the toner cartridge body on the same axis as that of the bridges and comes into contact with the guide frame when the releasing element has been rotated in the toner supply position.

29. A toner cartridge for supplying a toner to a toner hopper which has a shutoff lid for opening and closing a toner entrance port thereof, a guide frame disposed along the walls defining the toner entrance port for guiding the shutoff lid in the opening and closing direction thereof, a locking element for keeping the shutoff lid in the closed state and a fixing element fixing the locking element, via the toner entrance port by opening the shutoff lid in the toner supply position, comprising:

a releasing element which moves the fixing element so as to release the locked state by the locking element, the releasing element being formed with the toner cartridge body in such a manner as to be separable from the toner cartridge body by bridges, the releasing element being adapted to be rotatable about the same axis as that of the bridges; and a sealing element covering the toner supply opening of the toner cartridge body, with one end thereof attached to the releasing element, wherein a contact portion opposing the guide frame in the toner supply position is formed in the releasing element and the contact portion abuts the guide frame and functions as the fulcrum so as to act a leverage force on the bridges when the releasing element is rotated.

30. The toner cartridge according to claim 29, wherein the releasing element is formed of a material softer than that of the guide frame.

31. A toner cartridge for supplying a toner to a toner hopper which has a shutoff lid for opening and closing a toner entrance port thereof, a guide frame disposed along the walls defining the toner entrance port for guiding the shutoff lid in the opening and closing direction thereof, a locking element for keeping the shutoff lid in the closed state and a fixing element fixing the locking element, via the toner entrance port by opening the shutoff lid in the toner supply position, comprising:

a releasing element which moves the fixing element so as to release the locked state by the locking element; and a sealing element covering the toner supply opening of the toner cartridge body, with one end thereof attached to the releasing element, wherein the releasing element is connected to the toner cartridge body by multiple bridges and sub-bridges and is adapted to be rotatable about the same axis as that of the bridges, and the sub-bridges other than the above bridges which serve the rotational center have a smaller sectional area than that of the bridges.

32. A toner cartridge for use in a toner supply system which has a toner hopper including a shutoff lid for opening and closing a toner entrance port thereof, a guide frame disposed along the walls defining the toner entrance port for guiding the shutoff lid in the opening and closing direction thereof, a locking element for keeping the shutoff lid in the closed state and a fixing element fixing the locking element and opens the shutoff lid as the toner cartridge body is moved forwards so as to allow the toner to be supplied through the toner entrance port, wherein the cartridge body is provided on the front side thereof with a projected abutment which abuts the fixing element and moves it so as to allow the locking element to move and a switching portion which moves the locking element so as to move the shutoff lid.

33. The toner cartridge according to claim 32, wherein the projected abutment is located at a retracted position with respect to the front end of the toner cartridge body.

34. The toner cartridge according to claim 32, wherein the projected abutment and the switching portion are integrally formed and the projected portion is arranged to the front side with respect to the switching portion.

35. The toner cartridge according to claim 33, wherein more than one projected abutment are formed on the left and right sides on the front side of the toner cartridge body.

36. The toner cartridge according to claim 34, wherein more than one projected abutment are formed on the left and right sides on the front side of the toner cartridge body.

37. The toner cartridge according to claim 34, wherein an engaging portion that engages the locking element when the locked state is released and the engaging portion and the projected abutment are formed as one element and the projected abutment is located to the front side with respect to the engaging portion.

* * * * *